US007691041B2

(12) United States Patent
Abdo

(10) Patent No.: US 7,691,041 B2
(45) Date of Patent: Apr. 6, 2010

(54) EXERCISE MACHINE

(76) Inventor: John S. Abdo, 4143 Via Marina, Suite 1211, Marina Del Rey, CA (US) 90292

( * ) Notice: Subject to any disclaimer, the term of this patent is extended or adjusted under 35 U.S.C. 154(b) by 123 days.

(21) Appl. No.: 11/269,448

(22) Filed: Nov. 8, 2005

(65) Prior Publication Data

US 2006/0100070 A1 May 11, 2006

Related U.S. Application Data

(60) Provisional application No. 60/626,358, filed on Nov. 9, 2004.

(51) Int. Cl.
*A63B 26/00* (2006.01)

(52) U.S. Cl. ..... 482/142; 482/148

(58) Field of Classification Search ..... 482/92–95, 482/142, 70–71, 121–130, 51–52, 139, 148, 482/79
See application file for complete search history.

(56) References Cited

U.S. PATENT DOCUMENTS

| | | | | | |
|---|---|---|---|---|---|
| 3,759,511 | A * | 9/1973 | Zinkin et al. | 482/51 |
| 4,720,099 | A | 1/1988 | Carlson | 272/134 |
| 4,730,829 | A | 3/1988 | Carlson | 272/129 |
| 4,986,261 | A * | 1/1991 | Iams et al. | 601/35 |
| 5,066,003 | A * | 11/1991 | Jones | 482/137 |
| 5,356,359 | A * | 10/1994 | Simmons | 482/142 |
| 5,383,831 | A | 1/1995 | Drath | 482/101 |
| 5,613,924 | A * | 3/1997 | Lee | 482/51 |
| 5,669,860 | A * | 9/1997 | Reyes | 482/97 |
| 5,681,245 | A * | 10/1997 | Lin | 482/51 |
| 5,709,633 | A * | 1/1998 | Sokol | 482/62 |
| 6,036,622 | A * | 3/2000 | Gordon | 482/51 |
| 6,090,022 | A * | 7/2000 | Colecchi | 482/131 |
| 6,468,188 | B1 | 10/2002 | Koenig | 482/97 |
| 6,491,607 | B2 | 12/2002 | Simmons et al. | 482/93 |
| 6,500,099 | B1 * | 12/2002 | Eschenbach | 482/57 |
| 6,500,104 | B1 * | 12/2002 | Rich | 482/123 |
| 6,923,748 | B1 | 8/2005 | Mauz et al. | 482/70 |
| 6,962,554 | B2 * | 11/2005 | Keiser | 482/112 |
| 7,014,602 | B2 * | 3/2006 | Yamauchi | 482/142 |
| 7,108,645 | B2 * | 9/2006 | Lincoln | 482/142 |
| 7,128,702 | B2 * | 10/2006 | Boland et al. | 482/142 |
| 2003/0171193 | A1 | 9/2003 | Deola | 482/93 |
| 2004/0002409 | A1 | 1/2004 | Webb et al. | 482/98 |
| 2004/0014570 | A1 | 1/2004 | Centopani | 482/140 |
| 2004/0058790 | A1 | 3/2004 | Lapcevic | 482/123 |
| 2004/0209745 | A1 | 10/2004 | Riney et al. | 482/97 |
| 2005/0209055 | A1 * | 9/2005 | Anders | 482/51 |
| 2008/0096744 | A1 * | 4/2008 | Perry, Jr. | 482/144 |

FOREIGN PATENT DOCUMENTS

| | | |
|---|---|---|
| DE | 201 10 516 U1 | 11/2001 |
| FR | 2 703 595 | 10/1994 |

* cited by examiner

*Primary Examiner*—Lori Baker
(74) *Attorney, Agent, or Firm*—Westman, Champlin & Kelly, P.A.

(57) ABSTRACT

An exercise device includes an upper body rest pivotally attached to a base. A first leg swing is pivotally attached to the base for engaging a first leg of an exerciser to perform a first leg raise. A second leg swing is pivotally attached to the base for engaging a second leg of an exerciser to perform a second leg raise. The upper body rest supports the spinal column and torso of an exerciser when performing the first and second leg raises.

19 Claims, 17 Drawing Sheets

GMAX = GLUTEUS MAXIMUS
HAM = HAMSTRING

GMAX = GLUTEUS MAXIMUS
HAM = HAMSTRING

ROM = RANGE OF MOTION

ROM = RANGE OF MOTION

ROM = RANGE OF MOTION

QUAD = QUADRICEPS
GMAX = GLUTEUS MAXIMUS
HAM = HAMSTRING
ROM = RANGE OF MOTION

EXERCISE MACHINE

CROSS REFERENCE TO RELATED APPLICATIONS

The present application claims priority of U.S. Provisional Application No. 60/626,358, filed on Nov. 9, 2004, which is hereby incorporated by reference in its entirety.

BACKGROUND OF THE INVENTION

The present invention relates to an exercising machine. More particularly, the present invention relates to an exercising machine that exercises the buttocks, all sides of the upper legs, the hips, the hamstrings, lower abdomen and the lower back while maintaining an anatomical position that isolates the targeted muscle.

For many people, the buttocks, the lower abdomen, the hips, lower back and all sides of the leg; i.e., frontal, inner, outer and rear portions, are troublesome areas because excess weight in the form of fat accumulates in these areas and adversely affects the person's appearance and posture. From a functional perspective, many people have knee, hip, pelvic and spinal/lumbar joint weaknesses which are difficult to address with conventional exercises and machines. Most people find it difficult to isolate these areas during exercise to improve the person's strength and appearance.

There are many exercise devices in the market and numerous conventional exercises that attempt to target these troublesome areas. However, these exercises do not isolate the troubled areas because they do not position the exerciser in the proper anatomical position and/or specifically engage the muscles the exerciser is actually wanting to target. For instance, most, if not all of these exercises incorporate a knee bending action however when the knee joint is bending when trying to isolate and exercise the buttocks muscles it's actually the quadriceps muscles that are engaged preventing the buttocks muscles [i.e.; gluteus maximus and gluteus medius] from being effectively exercised. While the exerciser may be moving the exercising device, the exerciser will not achieve the results in strength, physical symmetry and appearance because the targeted muscle is not isolated or specialized on.

SUMMARY OF THE INVENTION

The present invention includes an exercise device having an upper body rest pivotally attached to a base. A first leg swing is pivotally attached to the base for engaging a first leg of an exerciser to perform a first leg raise. A second leg swing is pivotally attached to the base for engaging a second leg of an exerciser to perform a second leg raise. The upper body rest supports and relieves all pressure onto the spinal column and torso of the exerciser when performing the first and second leg raises.

DETAILED DESCRIPTION

Figure 1:
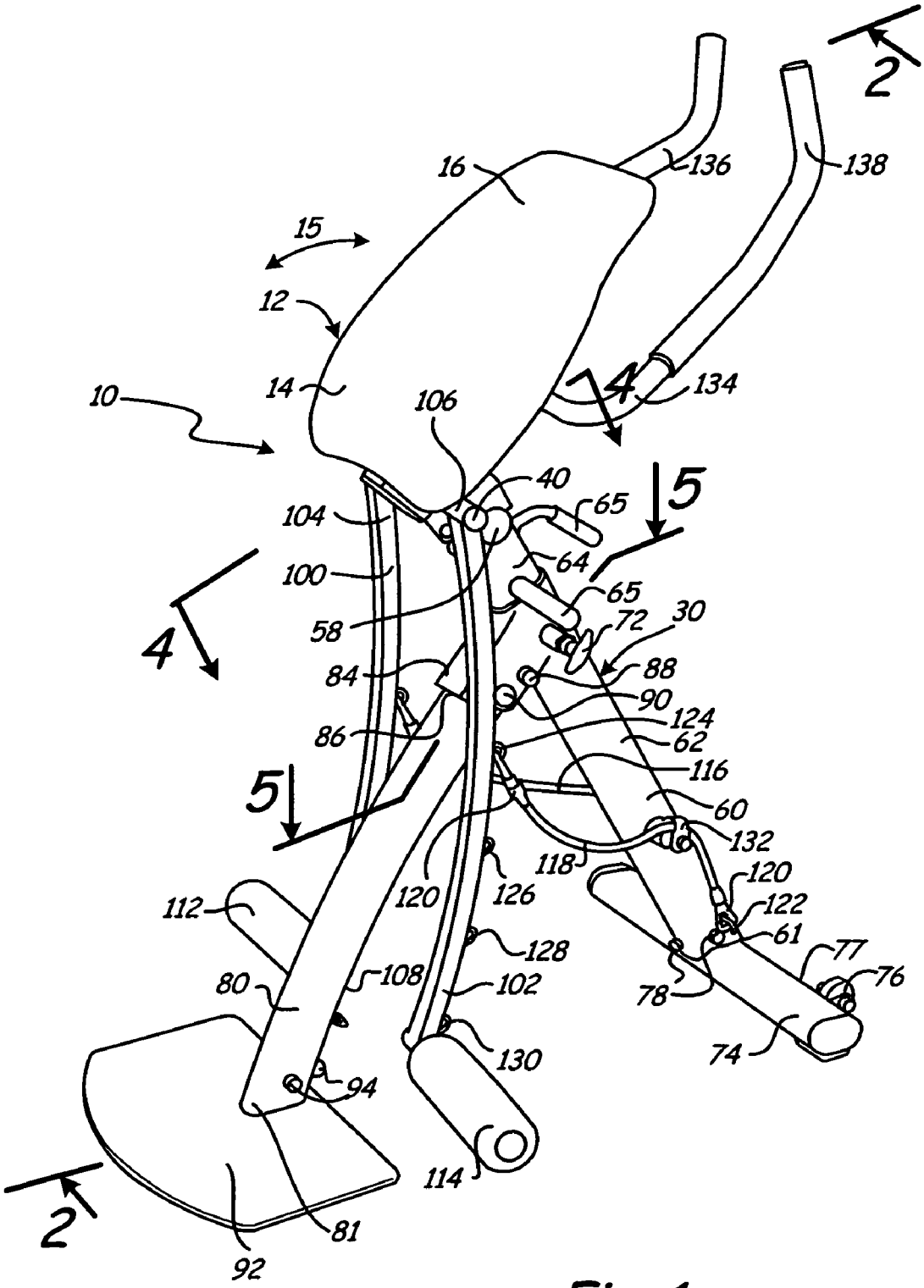
FIG. 1 is a perspective view of the exercising device of the present invention.

The exercising device of the present invention is generally illustrated in FIG. 1 at 10. The exercising device 10 is designed to position an exerciser in a comfortable yet anatomically correct position to effectively isolate and exercise muscle groups in a middle portion of the exerciser's body targeting the buttocks (gluteus maximus and gluteus medius), all sides of the upper legs, hips, lower back and lower abdominals. The exercising device 10 positions the exerciser in various anatomical positions such that various styles and angles of leg raises isolate and exercise the buttocks, hamstrings, quadriceps, hips, lower abdomen and lower back.

The exercising device 10 includes an upper body rest 12 that supports an upper body or torso of an exerciser where the upper body rest 12 is pivotally attached to a base 30 with a pivot pin 40. A lower portion 14 of the upper body rest 12 has a width to provide support across the lower portion of the exerciser's torso. An upper portion of 16 of the upper body rest has a width that is less than the width of the lower portion 14 where the upper portion 16 provides support for the upper portion of the exerciser's torso while allowing the exerciser's arm to freely move without interference from the upper body rest 12.

Figure 2:
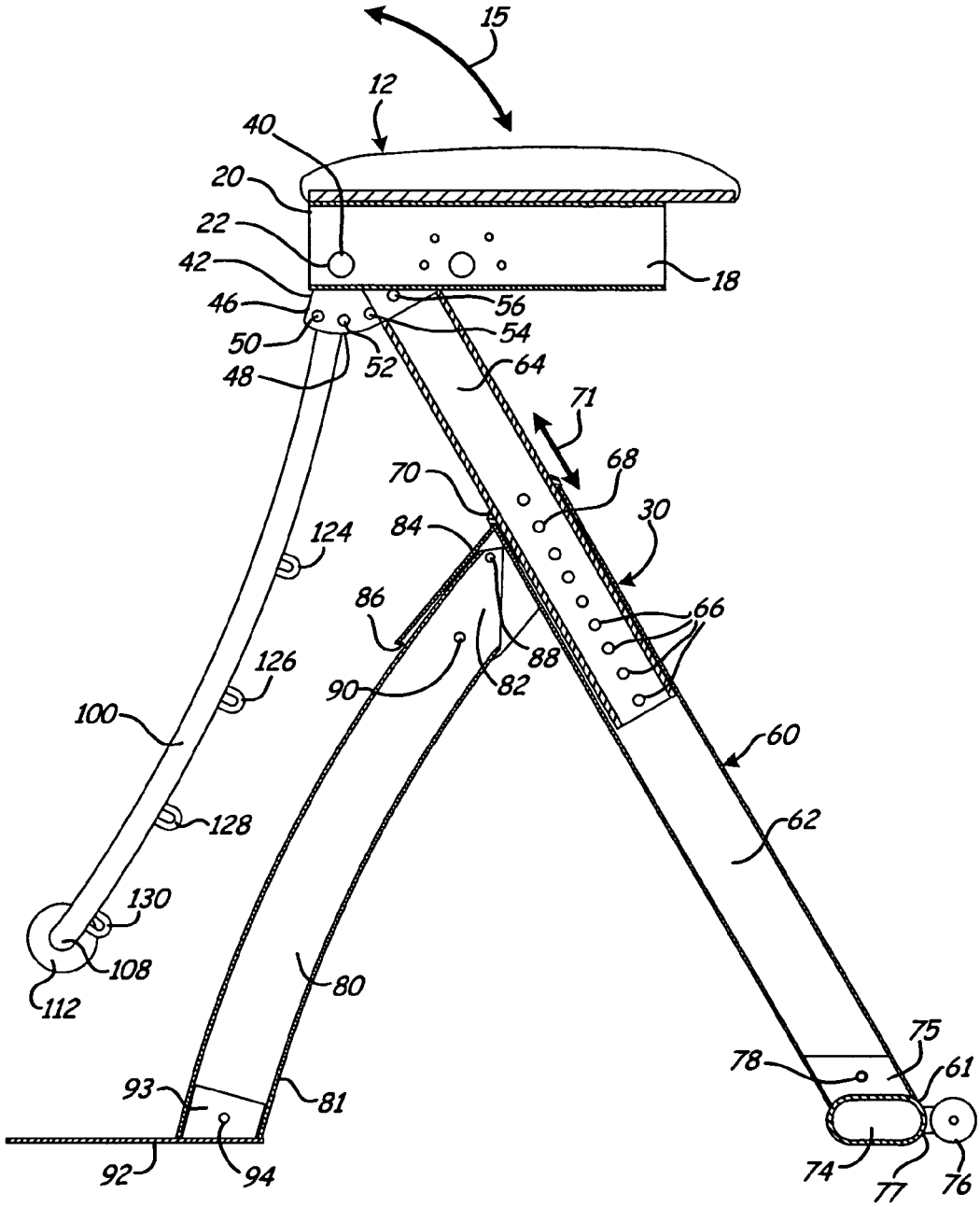
FIG. 2 is a sectional view of the exercising device of the present invention along section line 2-2 in FIG. 1 illustrating an upper body rest in a substantially horizontal or prone position.
Figure 3:
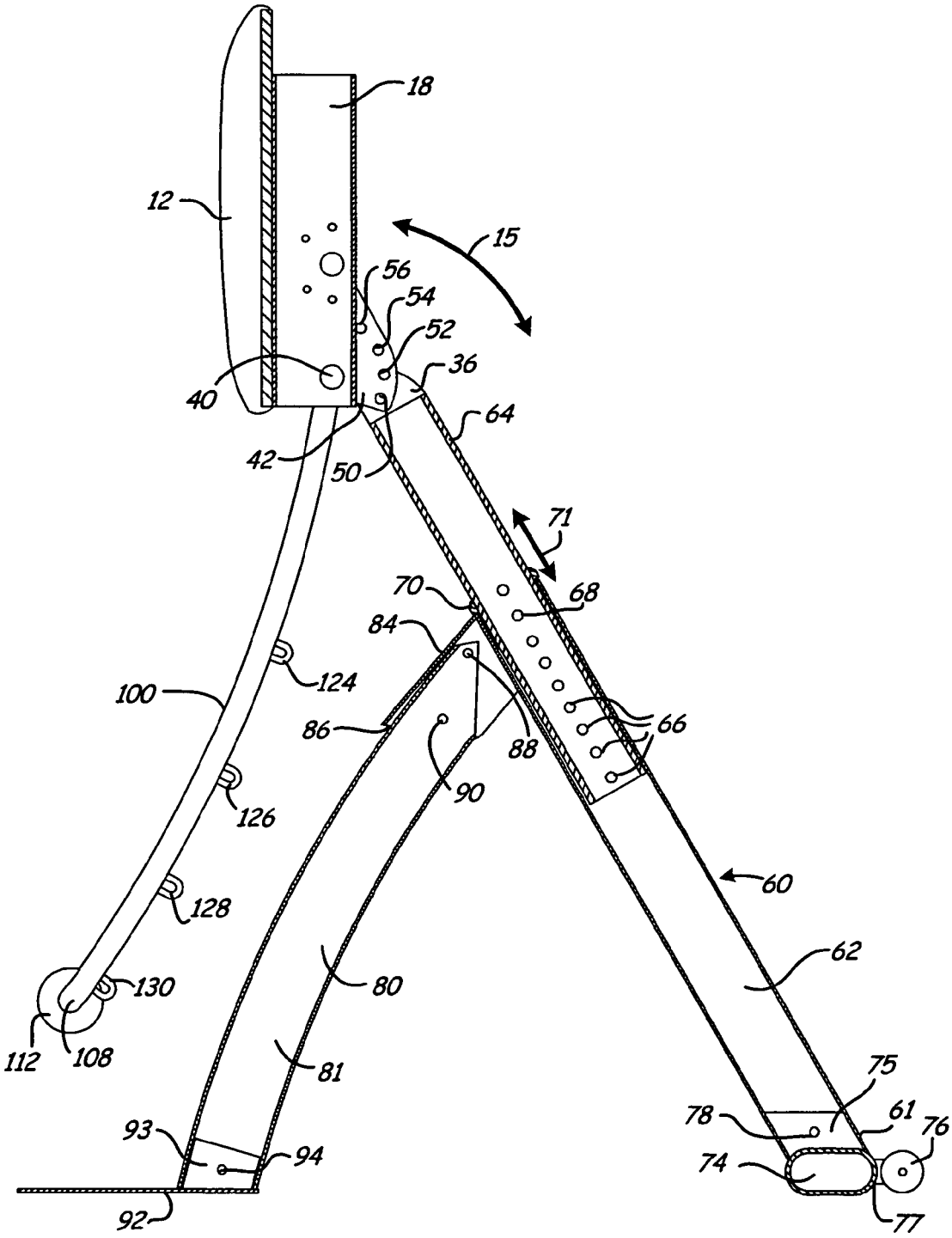
FIG. 3 is a sectional view of the exercising device of the present invention along section line 2-2 in FIG. 1 illustrating an upper body rest in a substantially vertical position.
Figure 4:
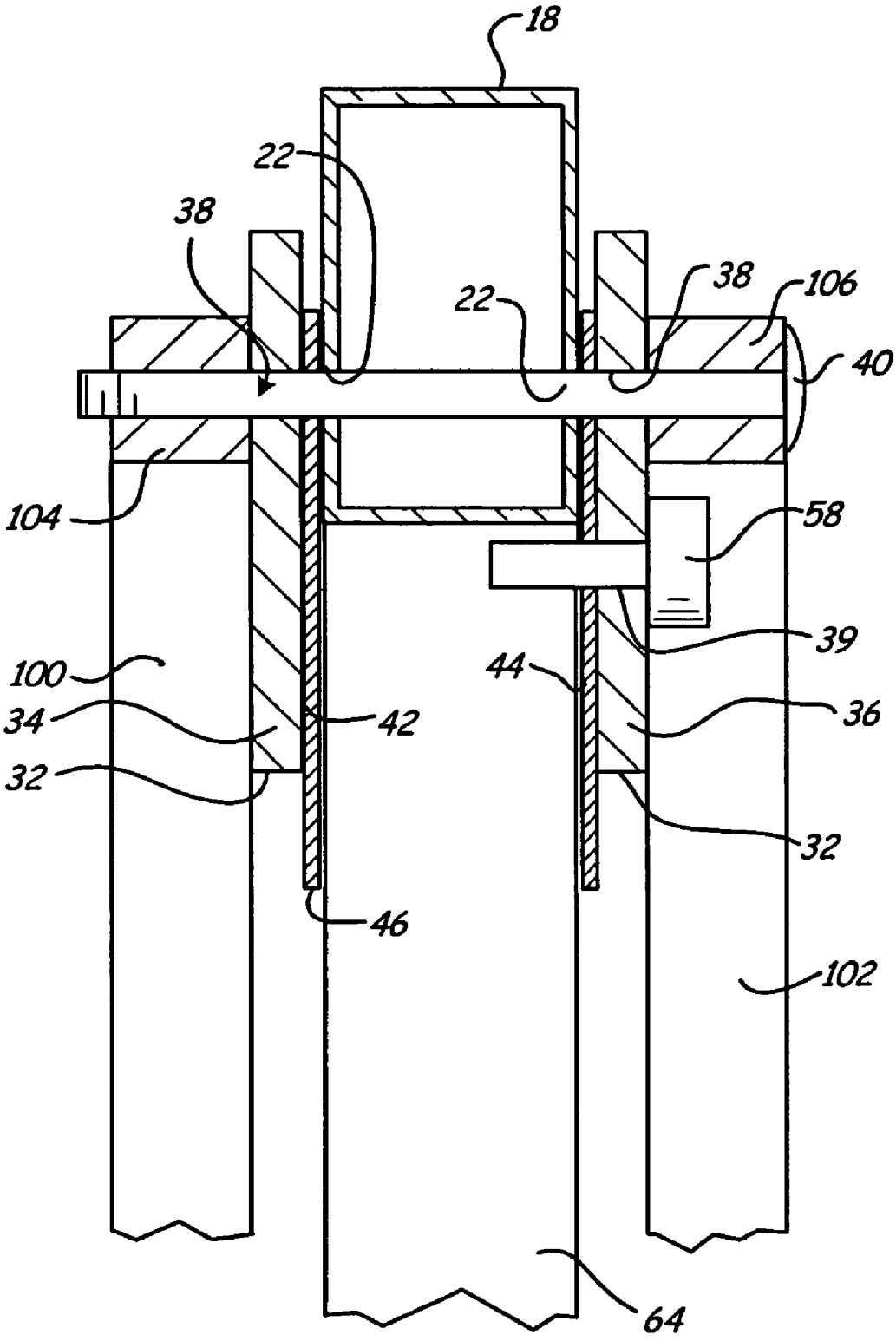
FIG. 4 is a sectional view of an attachment mechanism that secures the upper body rest to a base taken along section line 4-4 in FIG. 1.

Referring to FIGS. 2-4, a support 18 is attached to a back side of the upper body rest 12. The support 18 is substantially centrally located along a length of the upper body rest 12. The support 18 is typically constructed of a metal tube that preferably has a square or rectangular cross section.

The support 18 includes aligned apertures 22 through side surfaces proximate a proximal end 20. The aligned apertures 22 align with a first set of aligned apertures 38 in left and right tabs 34, 36 that are spaced apart a distance to accept the support 18 where the tabs 34, 36 extend from a top end 32 of the base 30. The pivot pin 40 is positioned through the aligned apertures 22, 38 to pivotally attach the support 18 to the base 30.

Left and right plates 42, 44 are attached to side surfaces of the support 18 proximate the proximal end 20, preferably with a weld. The left and right plates 42, 44 have similar configurations and include portions 46 that extend beyond a bottom surface of the support 18. The portions 46 and have arcuate edges 48 and a series of apertures 50, 52, 54 and 56 that are positioned an equal radial distance from the aperture 22.

The upper body rest 12 is positionable in a direction of arrows 15 from a substantially vertical position to a substantially horizontal position by pivoting the upper body rest 12 about the pivot pin 40. As the upper body rest 12 is pivoted about the pivot pin 30 from the substantially vertical position to the substantially horizontal position, one of the series of apertures 50, 52, 54 and 56 aligns with aperture 39 in the right tab 36 that is spaced the same radial distance from the first set of aligned apertures 38 as the series of apertures 50, 52, 54 and 56 are spaced from the apertures 22 in the right plate 44.

A pin 58 is positioned through the aperture 39 and one of the series of apertures 50, 52, 54, 56 to secure the upper body rest 12 in a selected position. When the pin 58 is position through the aperture 50, the upper body rest 12 is secured in a substantially vertical position. When the pin 58 is inserted into the aperture 56, the upper body rest 12 is secured in a substantially horizontal position. When the pin 58 is positioned into the aperture 52, the upper body rest 12 is secured in a position that is substantially 30 degrees from vertical. When the pin 58 is positioned into the aperture 54, the upper body reset 12 is secured in a selected position which is substantially 60 degrees from vertical. The pin 58 is typically a spring loaded pin, however other pins, rods or securing devices are within the scope of the present invention.

While the upper body rest 12 is typically positionable into four positions, a stationary upper body rest 12 is also within the scope of the present invention. An upper body rest 12 that is positionable into more or less than four positions and with a range of motion of greater than 90° is also within the scope of the present invention.

Referring to FIGS. 1-3, the base 30 includes a support column 60 that is positioned at about a 60° angle from a horizontal surface such as a floor. However the support column 60 can be positioned at any position that provides adequate support to the exerciser when using the exercise device 10 of the present invention.

The support column 60 includes a bottom portion 62 and a top portion 64 that telescopes within the bottom portion 62 in a direction of arrows 71. The top portion 64 and the bottom portion 62 are typically constructed of metal tubes that preferably have square or rectangular cross sections to prevent rotation of the top portion 64 within and the bottom portion 62.

As the top portion 64 is moved within the bottom portion 62 in the direction of arrows 71, a plurality of apertures 66 in the top portion 64 align with an aperture 68 proximate a top end 70 of the bottom portion 62. Handles 65 are attached to the three side walls of the top portion 64 to provide a surface for applying manual force to the top portion 64 to adjust the position of the top portion 64 within the bottom portion 62.

A spring loaded pin 72 is inserted into the aligned apertures 66, 68 to adjust a height of the upper body rest 12 to a selected position to properly support the torso of the exerciser. While a spring loaded pin 72 is typical, other pins or rods are within the scope of the present invention.

A support 74 is attached to a bottom end 61 of the bottom portion 62. The support 74 includes an extension 75 that is substantially centrally located on the support 74 that positions within the bottom end 61 of the bottom portion 62. Set screws 78 secure the extension 75 to the bottom portion 62 and thereby secure the support 74 to the support column 60. While set screws 78 are typically other fastening mechanism including, but not limited to, a threaded engagement, a screw and a pin are within the scope of the present invention.

The support 74 provides stability to the exercise device 10 and prevents the exercise device 10 from accidentally tipping while standing or in use. Wheels 76 are rotatably attached to a front surface 77 of the support 74 such that when the device 10 is pivoted about the support 74, the wheels 76 engage the floor such that the device 10 can be easily moved.

The base 30 also includes an angled support 80 that is pivotally attached proximate the upper end 70 to the bottom portion 62 of the support column 60. The angled support 80 is typically constructed of a metal tubular material having a square or rectangular cross-section.

A distal end 82 of the angled support 80 is pivotally attached to a U-shaped brace 84 with a pivot pin 88. The U-shaped brace 80 extends from the top end 70 of the bottom portion 62 where the U-shaped brace 80 is typically attached to the bottom portion 62 with a weld.

Figure 5:
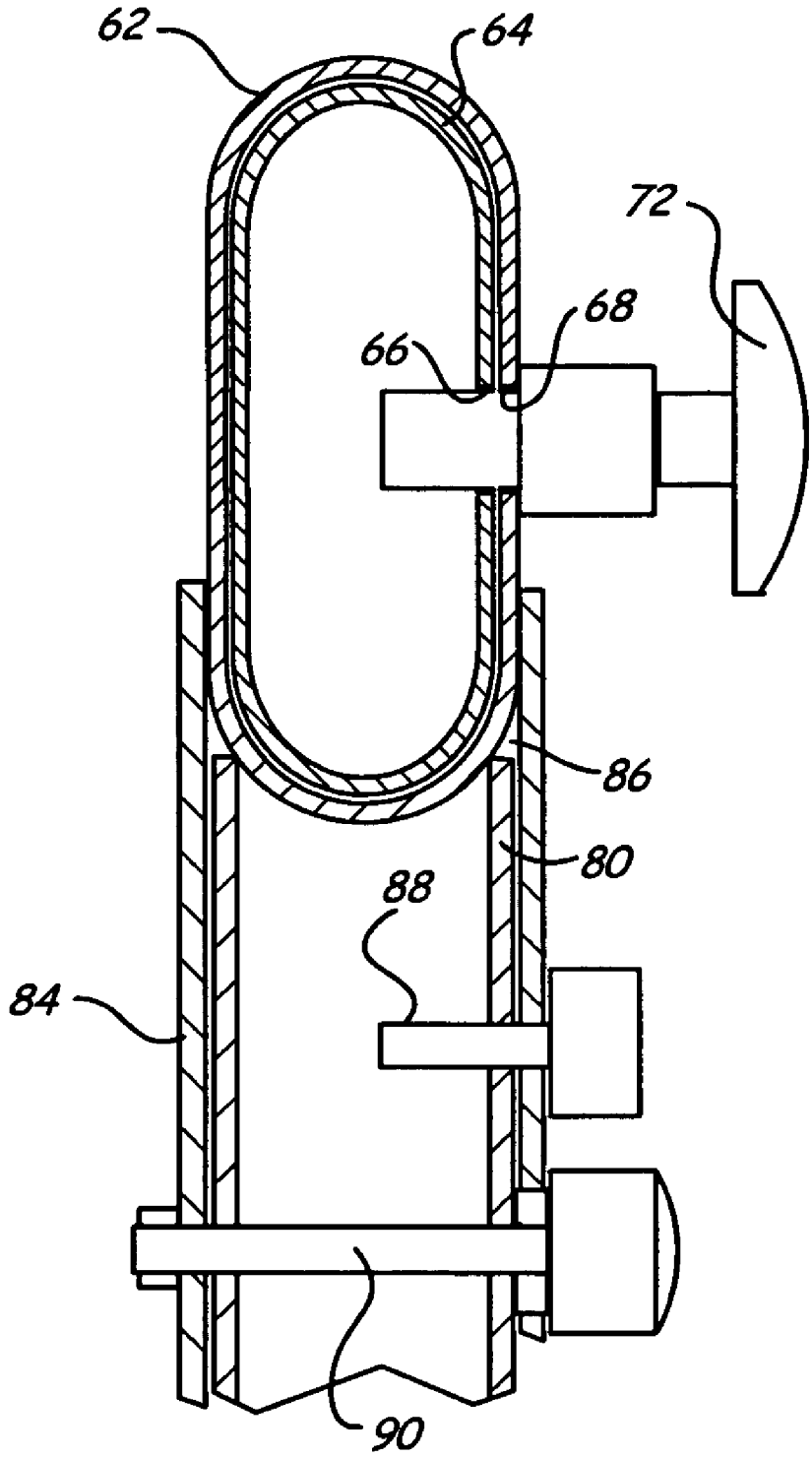
FIG. 5 is a sectional view of an attachment mechanism that secures an angled support to a main column of a base taken along section line 5-5 in FIG. 1.

Referring to FIG. 5, a channel 86 in the U-shaped brace 84 accepts the distal end 82 of the angled support 80. With the angle support 80 positioned within the channel 86, apertures in the angled support 80 align with apertures in the U-shaped brace 84 such that a spring loaded pin 90 is positioned within the aligned apertures to secure the angle support 80 in a selected position to the support column 60. When secured to the U-shaped brace 84, the angled support 80 provides stability to the exercising device 10 while standing or in use.

A plate 92 is attached to a proximal end 81 of the angled support 80. The plate 92 includes an extension 93 that is positioned within the proximal end 81 of the angled support 80. Set screws 94 secure the extension 93 to the angled support 80 and thereby secure the plate 92 to the angled support 80. While set screws 94 are typical, other fastening mechanism including, but not limited to, a threaded engagement, a screw and a pin are within the scope of the present invention.

The plate 92 provides stability to the exercise device when not in use. When in use, the exerciser places one foot on the plate 92 such that the weight of the exerciser is placed upon the plate 92 to aid in stabilizing the exercise device 10.

The base 30 collapses for storage by disengaging the spring loaded pin 90 from the angled support 80. With the pin 90 disengaged from the angled support 80, the angled support 80 can be pivoted about the pivot pin 88 and proximate the support column 80 to reduce the size of the exercise device 10 for storage.

The exercise device 10 also includes left and right leg swings 100, 102. Upper ends 104, 106 of the left and right leg swing 100, 102 are pivotally attached to the proximal end 20 of the support member 18 and the left and right tabs 34, 36 of the base 30 with the pivot pin 40. The left and right leg swings 100, 102 are mirror images of each other and have a generally arcuate configuration and are independently movable with respect to each other. When the exercise machine 10 is not in use, the left and right leg swings 100, 102 are in a substantially vertical position due to gravitational forces.

The left and right leg swings 100, 102 include extensions 112, 114, respectively, that are attached proximate lower ends 108, 110 of the left and right leg swings 100, 102. The extensions 112, 114 extend outwardly from the leg swings 100, 102 such that the exerciser's lower leg engages the extensions 112, 114. The extensions 112, 114 typically include a padding that rotates about an axle where the padding provides comfort to the lower leg of the exerciser.

The left and right leg swings 100, 102 may optionally have telescoping portions (not shown) that allow the exerciser to adjust a length of the leg swing. The left and right leg swings 100, 102 also may optionally have stirrups (not shown) for securing the left and right feet therein, respectively. The left and right leg swings 100, 102 are typically ridge members, however, flexible leg swings are also within the scope of the present invention.

The effort required to pivotally move the left and right leg swings 100, 102 may be adjusted by attaching resistance bands 116, 118 to each leg swing 100, 102, respectively, and the lower portion 62 of the support column 60. Clasps 120 are attached to each end of the resistance bands 116, 188 and each clasp 120 engages a loop 122 extending from side surfaces of the lower portion 62 of the support column 60 and one of four loops 124, 126, 128 and 130 positioned along the length of each leg swing 100, 102. While four loops attached to each leg swing 100, 102 is typical, leg swings 100, 102 with more or less than four loops are within the scope of the present invention.

The least amount of resistance provided by the resistance bands 116, 118 is incurred when the clasp 120 engages the loop 124. As the clasp 120 sequentially engages the loops 126, 128 or 130, the resistance is increased because of the distance from the point of resistance to the pivot pin 40 increases and requires more effort to move the leg swings 100, 102. Therefore, the same resistance bands 116, 118 can be attached to different locations on the leg swings 100, 102 to provide different amounts of resistance for the exerciser.

Typically each resistance band 116, 118 is positioned through a guide 132 attached to the side surfaces of the lower portion 62. The guide 132 is substantially the same radial distance from each loop 124, 126, 128 and 130 and therefore provides resistance through the range of motion of the leg swings 100, 102, independent of which loop 124, 126, 128 and 130 is being engaged by the clasp 120 of the resistance bands 116, 118.

While resistance bands are typical, other adjustable resistance devices are also within the scope of the present invention. Other adjustable resistance devices that may be employed in the exercise device of the present invention include a strap engaging the leg swing, an electromagnetic resistance at the pivotal attachment of the leg swings to the base, a tension gauge at the pivotal attachment of the leg swings, a frictional engagement at the pivotal attachment of the leg swings, hydraulic and/or air compressed chambers, resilient bands and/or discs attached to the upper body rest or the support column as well as positioning additional weight along the length of the leg swing.

Alternatively, the leg swings 100, 102 may be constructed of a flexible material where proximal ends 104, 104, respectively, are fixedly attached to the base 30. As the leg swings 100, 102 are moved during a leg raise exercise, the leg swing 100, 102 flexes to provide resistance. The leg swings 100, 102 may be constructed of a single member of flexible material or multiple layers of flexible material that are connected changes the resistance incurred during the leg swing exercise. A typical material of construction for the flexible leg swings is polyoxy-methylene which is sold under the Delrin® trademark by E. I DuPont de Nemours and Company of Wilmington, Del. However other materials of construction are within the scope of the present invention.

A generally U-shaped arm rest 134 is pivotally attached to the support member 18 that is attached to the upper body rest 12. The generally U-shaped arm rest 134 includes hand grips 136, 138 that provide the exerciser comfort and stability during use of the exercising device 10. The upper body rest 12 and the hand grips 136, 138 are preferably padded to provide comfort to the exerciser. The upper body rest 12 and the hand grips 136, 138 are also preferably covered with a durable material that may be moisture resistant and protect the padding underneath the moisture resistant cover from being saturated with perspiration. Alternatively, the upper body rest 12 and the hand grips 136, 138 may be covered with an absorbent material that wicks perspiration from the exerciser.

The exercising device 10 of the present invention isolates and exercises a number of different muscles depending upon the position of the exerciser on the exercising device 10. A range of motion of a leg during a leg raise is manipulated by positioning the upper body rest 12 in a selected position. When the upper body rest 12 and the exerciser's torso are in a more horizontal position, the range of motion of the leg and the amount of muscle activity increases.

Figure 6:
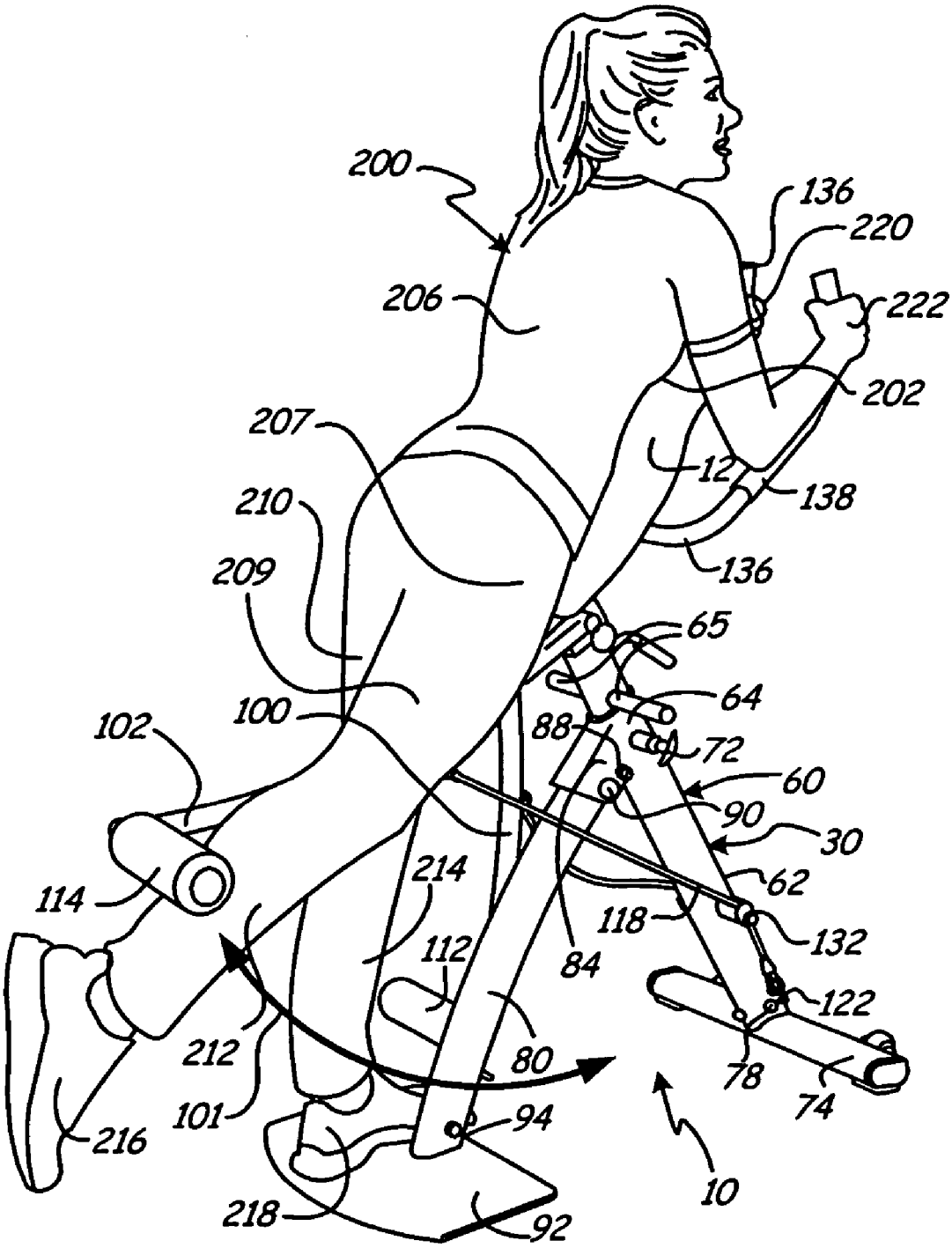
FIG. 6 is a perspective view of the exercising device of the present invention in use while isolating the buttocks muscles, hamstrings and lower back with a rearward leg raise with a rigid knee.

The range of motion of the leg is minimized when the upper body rest 12 is in the substantially vertical position as illustrated in FIG. 3 where the range of motion is about 20° from vertical when performing a back leg swing as illustrated in FIG. 6. The range of motion is maximized when the upper body rest 12 is in the substantially horizontal position or prone position as illustrated in FIG. 2 where the range of motion is about 60° from vertical when performing the back leg raise as illustrated in FIG. 6. With the upper body rest 12 secured in one of the intermediate positions between vertical and prone where the pin 58 is positioned through one of the apertures 54 and 52, the range of motion is about 30° from vertical and about 40° from vertical, respectively, when performing the back leg swing as illustrated in FIG. 6. However, the range of motion will vary from exerciser to exerciser depending upon the exerciser's level of fitness and flexibility.

When the exerciser determines to increase the resistance by utilizing the resistance bands 116, 118, the resistance is minimized when the clasp 120 is engaged to the loop 124 closest to the pivot pin 40. The resistance is maximized when the resistance bands 116, 118 engage the loop 130 which is the furthest distance from the pivot pin 40. Therefore each exerciser can customize his/her workout by adjusting the position of the upper body rest 12 as well as adjusting the position of the engagement of the resistance bands 116, 118 with the leg swings 110, 102, respectively.

Referring to FIG. 6, an exerciser 200 is illustrated performing a leg raise that isolates the gluteus maximus muscle. The exerciser 200 is substantially upright and the exerciser's chest 202 is positioned adjacent the upper body rest 12 in a position between vertical and horizontal. A left foot 218 engages the plate 92 and the left leg 210 is substantially straight. The exerciser 200 positions a back side of a lower portion 212 of a right leg 209 against the padded extensions 114 and swings his/her leg along with the leg swing 102 in a direction of arrows 101 while articulating a hip joint 207.

As the right leg 209 is moved in the direction of arrows 101, the padded extension 114 rotates about the axle and ascends the backside of the lower portion 212 of the right leg 209. As the extension 114 rotatably acends the lower portion 212 of the right leg 209, the leverage and stress to the knee joint and the hip joint is decreased as the resistance on the targeted muscle is maximizing. The rotational movement of the extension 114 up the lower portion 212 of the right leg 209 effectively targets the selected muscle while minimizing the stresses on the knee joint and hip joint. The anatomical position of the exerciser's torso along with the movement of the leg isolates the upper hamstrings, the buttocks (gluteus maximus) and the lower back. The exercise can be done in an alternating fashion where a lower portion 214 of the left leg 210 is lifted which engage the extension 112 and followed by the lower portion 212 of right leg 209 engaging the extension 114, or in sets were the left leg 210 is lifted for a selected number of repetitions followed by a set for the right leg 212, or vice versa. When performing the left leg 210 raises, a right foot 216 is positioned on the plate 92. Hands 220, 222 grip the hand grips 136, 138 to provide stability to the exerciser 200 during the leg raise exercise.

Figure 7:
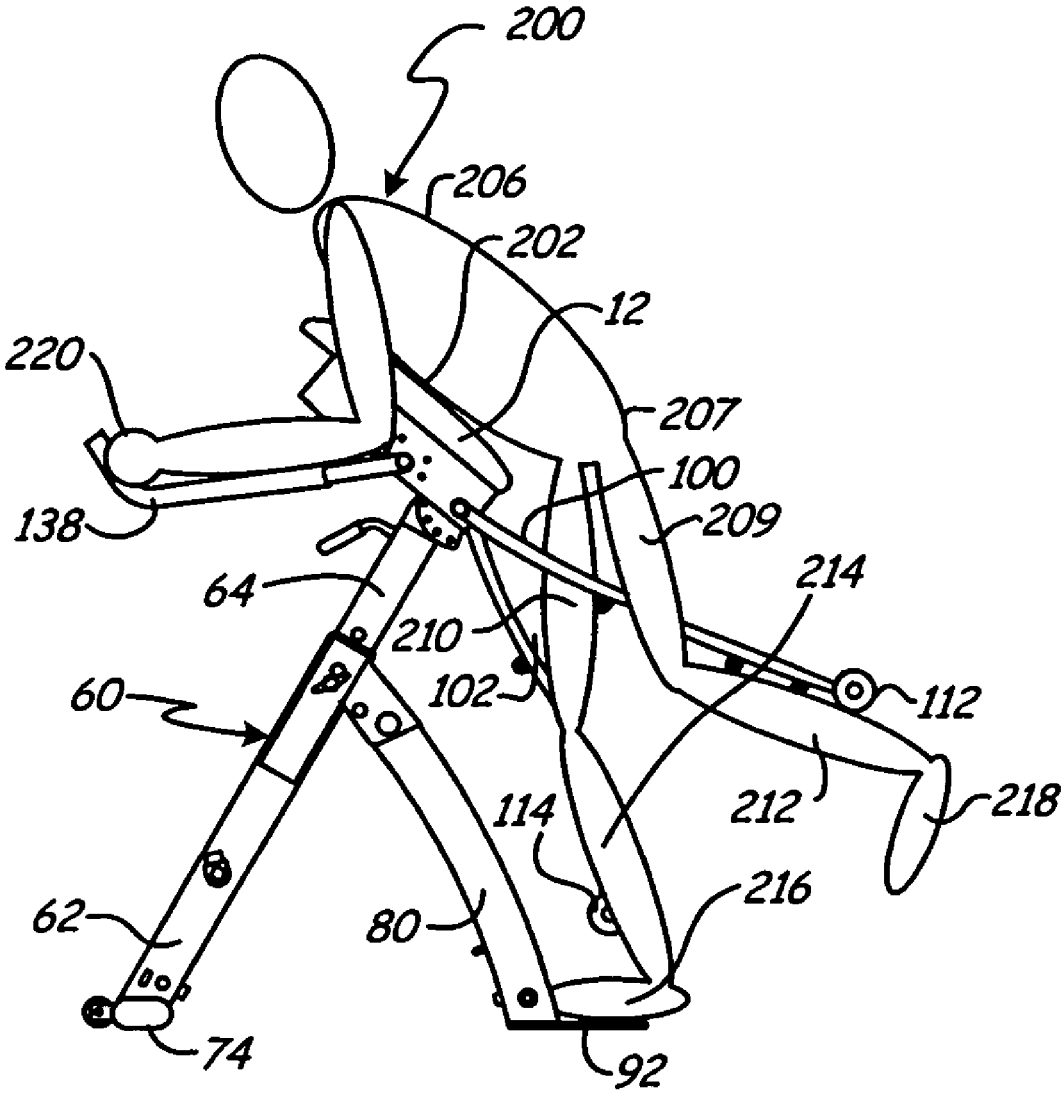
FIG. 7 is a schematic view of an exerciser using the exercising device of the present invention showing a rearward bent-knee flexion motion while isolating his/her hamstring muscles with the upper body rest in a generally upright position.

Throughout the application, like anatomic parts will be given like reference characters. Referring to FIG. 7, the leg raise exercise can also be performed using a bent knee where the hamstring is contracted. As the exerciser 200 moves his/her left leg 210 in the arcuate path along with the leg swing 102, less emphasis is placed onto the buttocks and the lower back while the hamstrings become better isolated and exercised.

Figure 8:
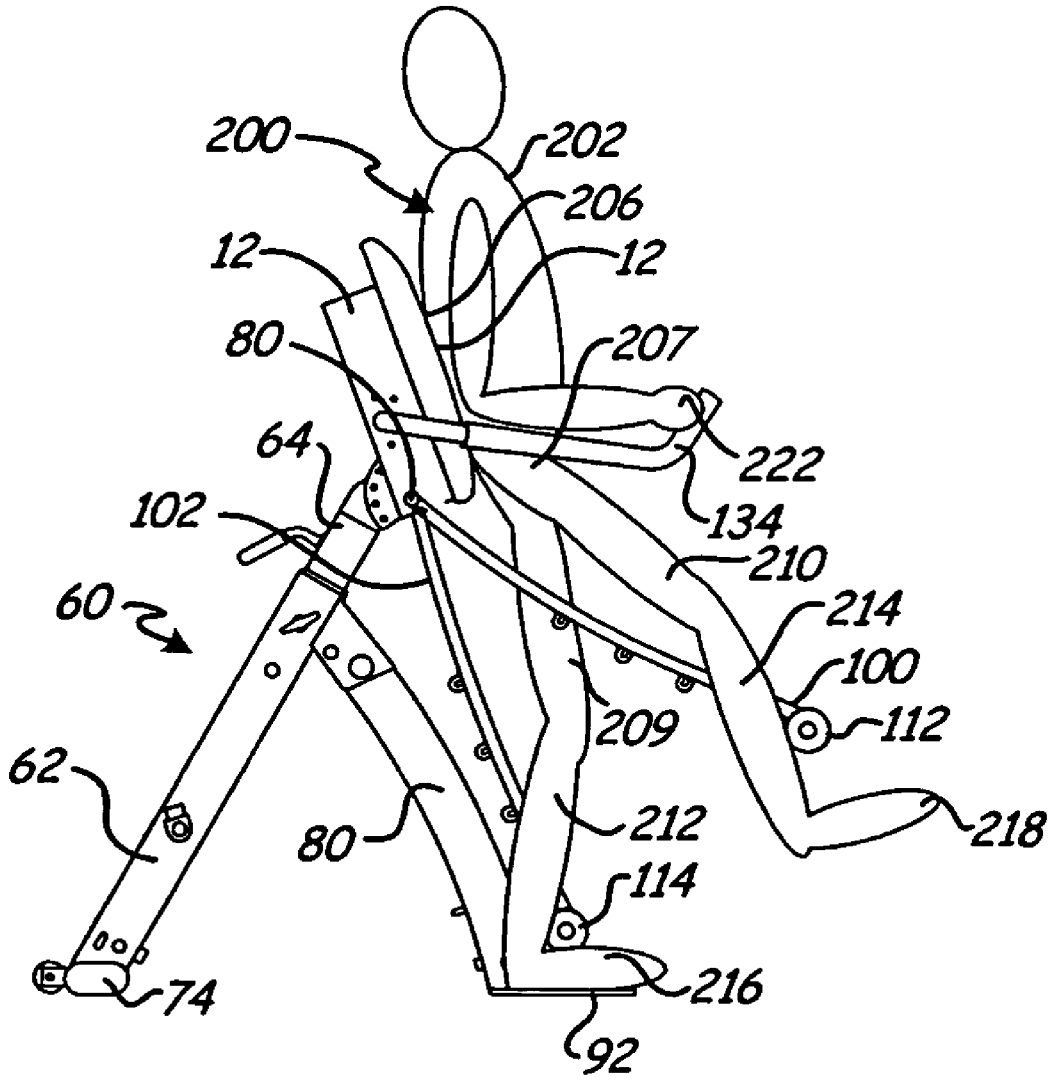
FIG. 8 is a schematic view of an exerciser using the exercising device of the present invention while doing forward leg raises and exercising the quadriceps muscles on the front of the leg, hips and lower abdomen.

By positioning the exerciser's body in different positions, other muscle groups may be exercised. Referring to FIG. 8, the exerciser 200 can position his/her back 204 against the upper body rest 12 and engage the left and right padded extensions 112, 114 with the lower portions 212, 214 or the left and right legs 209, 210, respectively. The exerciser raises his/her feet 216, 218 individually along with the leg swing 100, 102 with the knee fully extended such that the leg is substantially straight. This movement isolates and exercises the hip flexors, the abdomen and the upper thighs. To perform this exercise the arm rest 134 is repositioned proximate a midpoint of the upper body rest 12 so that the exerciser can grip the hand grips 136, 138 with the hands 220, 222 and rest his/her arms on the arm rest 134.

Figure 9:
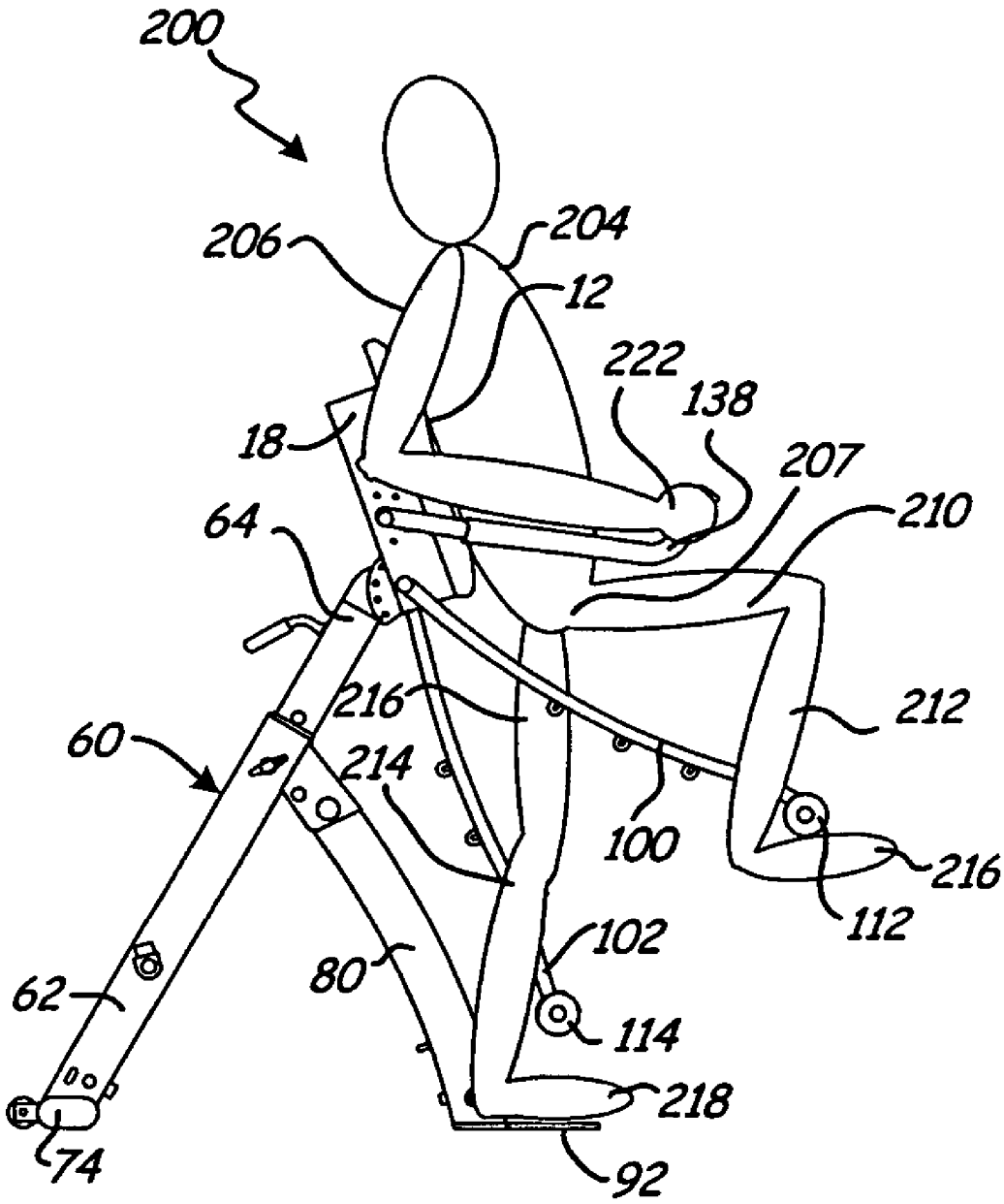
FIG. 9 is a schematic view of an exerciser using the exercising device of the present invention while doing forward/upward bent-knee leg raises and exercising the quadriceps muscles on the front of the leg, hips and the lower abdominal muscles.

Referring to FIG. 9, the exerciser 200 can position his/her back 204 against the upper body rest 12 and engage the left and right padded extensions 112, 114 with the bottom portions 212, 214 of the left and right legs 209, 210 respectively. The exerciser 200 raises his/her feet 216, 218 individually with a bent knee and swings the leg swings 100, 102. This movement isolates and exercises the hip flexors, the abdomen and the upper thighs. To perform this exercise, the arm rest 132 is positioned proximate a midpoint of the upper body rest 12 so that the exerciser can grip the hand grips 136, 138 with the hands 220, 222 and rest his/her arms on the arm rest 132. This exercise can be performed using sets or alternating leg swings as previously described.

Figure 10:
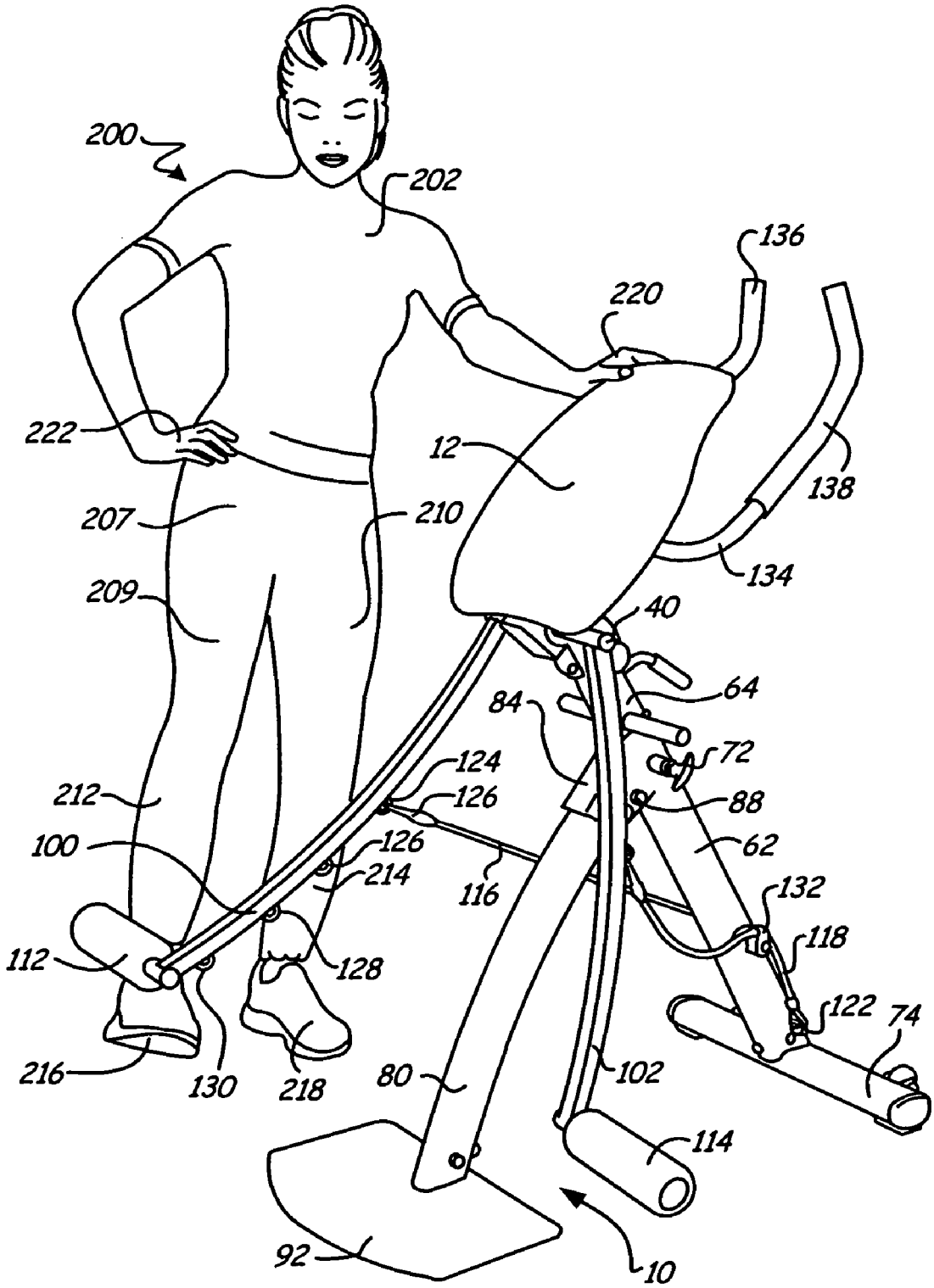
FIG. 10 is a perspective view of an exerciser using the exercise device of the present invention performing outer leg raises flexing the abductor muscles of the legs and hips, the buttocks, obliques and lower abdomen.

Referring to FIG. 10, the exerciser 200 positions an outer side of his/her lower portion 214 of the leg 210 against the padded extension 112 of the swing leg 100 and raises his/her foot 216 through an arcuate path. This exercise is also referred to as an outer leg raise. As the foot 218 is raised, the outer hip flexor, the outer thigh, the buttocks and the obliques are isolated and exercised.

With the exerciser 200 in the same position, the exerciser 200 engages an inner side of the lower portion 214 of the left leg 210 and raises his/her foot 218 through an arcuate path. This exercise is also referred to as an inner leg raise where as the foot 218 is raised the inner thigh or groin and the hamstring are isolated.

The exerciser 200 can also move to the opposite side of the exercise device 10 and engage an inner side of the lower portion 212 of the leg 209 with the padded extension 114 of the leg swing 102. The exerciser 200 then raises his/her foot 216 through an arcuate path to perform an inner leg raise to exercise the inner thigh or groin and the hamstring of the right leg 209.

The exerciser 200 can perform an outer leg raise with the left leg 210 while in the same position by engaging an outer side of the lower portion 214 with the padded extension 114 of the leg swing 102. The exerciser 200 raises his/her food 218 in an arcuate path to isolate and exercise the outer hip flexor, the outer thigh, the buttocks and the obliques.

Figure 11:
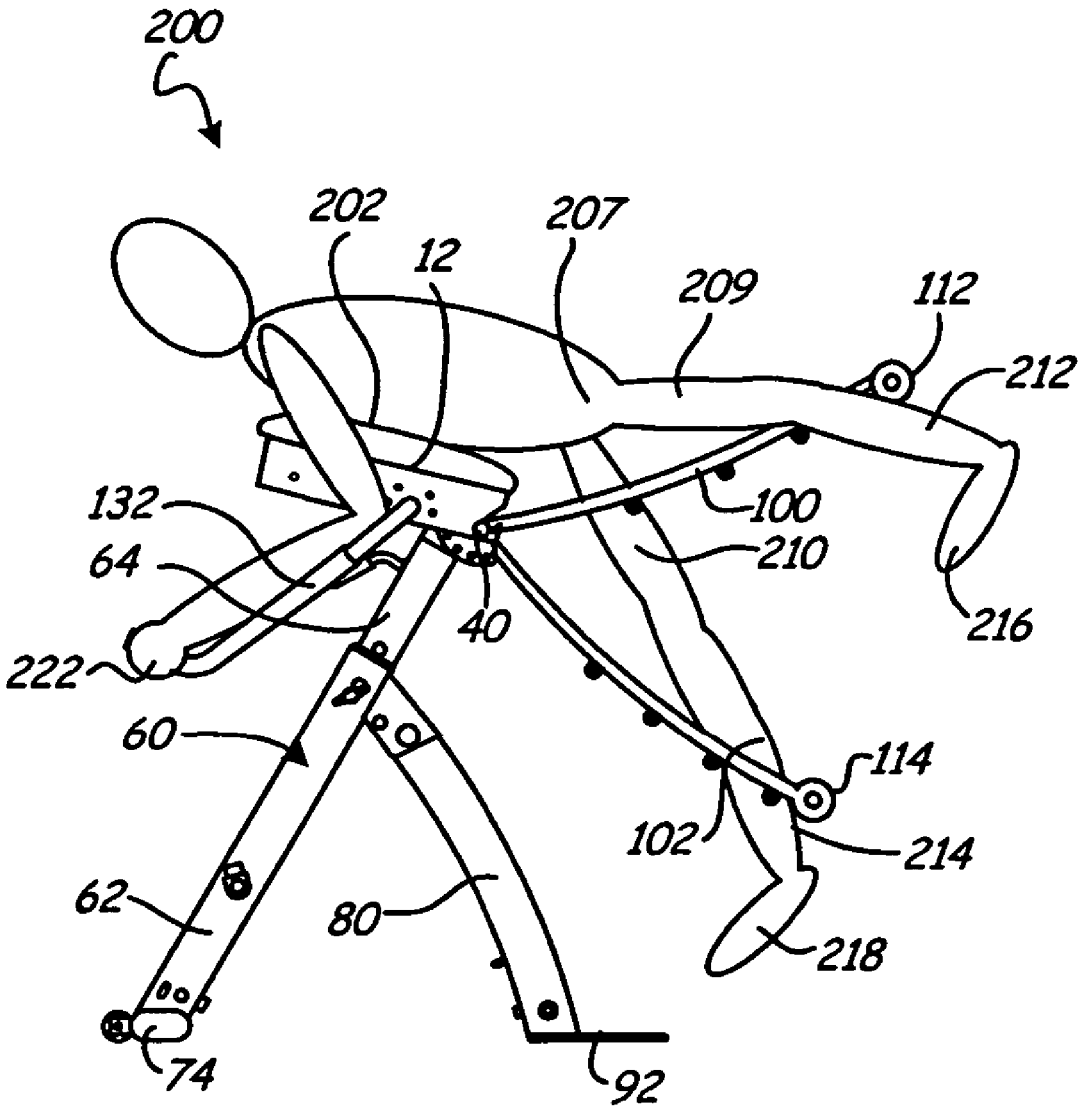
FIG. 11 is a schematic view of an exerciser using the exercise device of the present invention while elevated above a floor and exercising the buttocks muscles and the hamstring muscles.

Referring to FIG. 11, the exerciser 200 can position the upper body rest 12 in the substantially horizontal or prone position and position the chest 202 on the upper body rest 12.

The exerciser 200 extends both legs 209, 210 and engages the lower portions 212, 214 of the legs 209, 210 with the padded extensions 112, 114 of the leg swings 100, 102, all respectively, such that no portion of the exerciser 200 touches the ground. With the feet 216, 218 elevated, the legs 209, 210 can raise the leg swings 100, 102 either alternatively, in unison or in sets of repetitions. This exercise isolates and exercises the hamstrings, the buttocks and the lower back. This exercise can also be performed with or without additional resistance.

Figure 12:
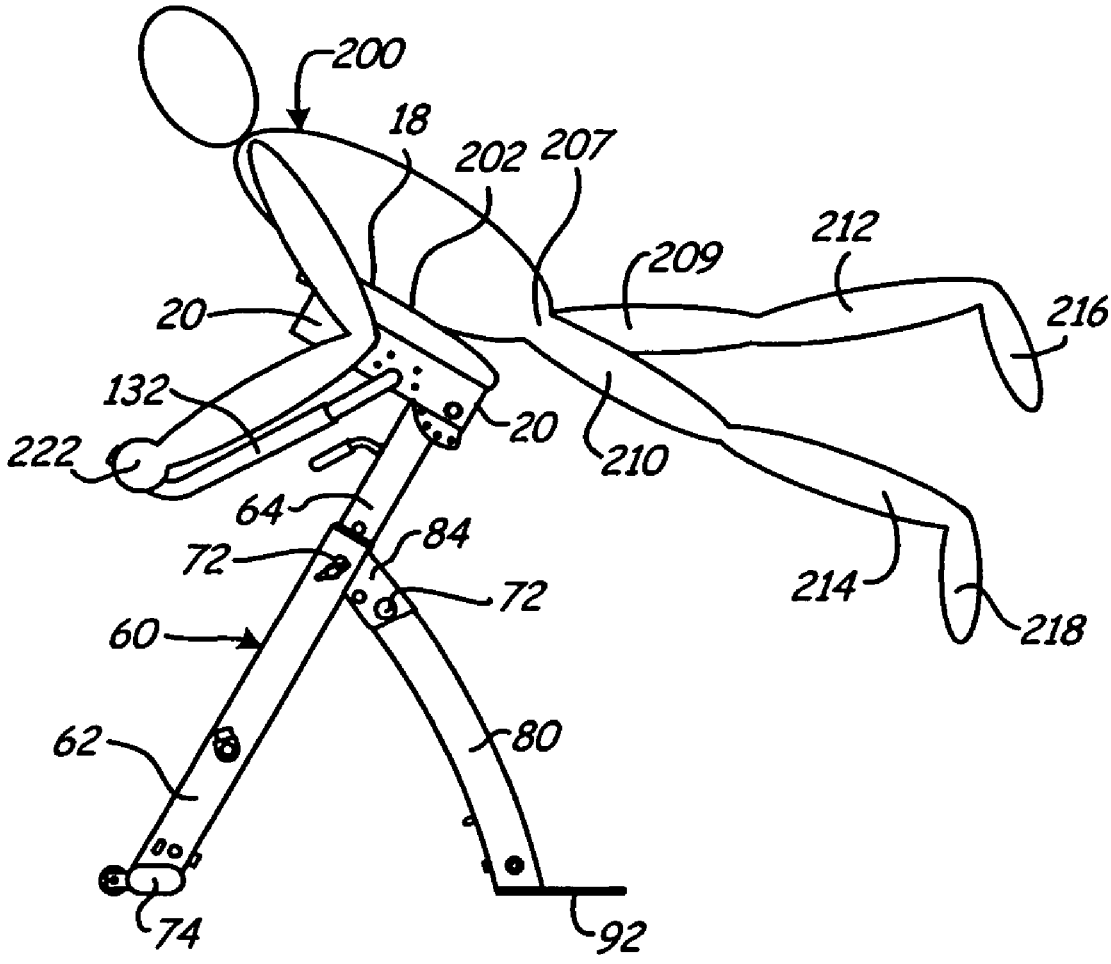
FIG. 12 is a schematic view of an exerciser using the exercise device of the present invention while elevated above a floor and exercising the buttocks muscles and the hamstring muscles without employing the use of the leg swings and relying on the weight of the exercisers legs and gravitational force to serve as the resistance.

Alternatively, referring to FIG. 12, the leg swings 100, 102 can be removed from the upper body rest 12 and the upper body rest 12 is positioned in the prone or angled position. The exerciser 200 positions his/her chest 202 onto the upper body rest 12 and maintains the legs 209, 210 in a substantially straight unsupported position. The exerciser 200 raises and lowers his/her legs 209, 210 either together or separately. This movement isolates and exercises the lower back, the buttocks, hips and the hamstrings.

It has been discovered that the use of the present invention better isolates and exercises the gluteus maximus or buttocks and the hamstrings when compared to squats, lunges and step-up. The following example is illustrative only and is not intended to limit the present invention in any way.

EXAMPLE 1

Eight healthy female participant ranging in ages from 20-26 and having a mean average age of 22.9 years were used to evaluate the effectiveness of the exercise device 10 of the present invention in relationship to other known conventional exercising methods. The study was conducted at the University of Michigan's Motor Control Laboratory located in Ann Arbor, Mich.

The study compared the effectiveness of conventional exercises including squats, lunges and step-ups with and without barbell weights equal to approximately 20% of the subject's body weight with the exercise device 10 of the present invention. The exercise device 10 was evaluated at three different range of motion settings by adjusting the position of the upper body rest 12 into three different settings ranging from substantially vertical to substantially horizontal. Further, the resistance was modified on the exercise machine of the present invention by attaching the resistance band 116, 118 to different loops 124, 126, 128, 130 positioned along the length of the leg swings 100, 102.

The effect of each of the exercises was measured using a surface electromyogram machine (EMG) where electrodes were positioned on the skin of the participant which overlies the muscle being analyzed to detect the electrical activity of the muscle. The electrodes transfer the electric activity detected in the muscles to the EMG.

When muscles are active, the muscles produce an electric current, also referred to as firing, that is typically proportional to the level of the muscle activity. The EMG detects and correlates the electric current to muscle activity.

The EMG processes and records the electric signal to determine an average rectified value (ARV) of quantified muscle activity between the onset and the offset of the muscle activity. The ARV was calculated by integrating the area of firing detected and recorded by EMG between the onset and the offset of the muscle activity. The sum of the integrated area was divided by the duration of the muscle activity to determine the ARV.

The ARV was then normalized to determine an EMG activation amplitude for each muscle for each individual subject. The EMG activation amplitudes were expressed as a percentage of the peak muscle contraction amplitude, thus making it possible to compare the EMG firing activity across muscles and subjects. The testing method also permitted comparison of the relative EMG activity for the same type of movement with different exercise equipment. As a way of illustration, a muscle that has a larger ARV and EMG activity indicates that the muscle is more active than when the muscle exhibits a lower ARV and EMG activity.

The results of the study indicate that the exercise device of the present invention better isolates the prime mover muscles when compared to the conventional exercises of squats, lunges and step-ups. By prime mover muscle is meant the muscle or muscle groups that the exercise intended to isolate. With greater prime mover muscle activity, greater strength gains and shaping of the specific muscles are achieved when compared to the conventional exercises including lunges, squats and step-ups.

The results of the tests also indicate that the exercise machine of the present invention increases the muscle activity of the prime mover muscles as the resistance and range of motion are increased. Further, as the resistance and range of motion are increased, there is a reduced activity of the secondary muscles which increases the isolation to the prime mover muscles and achieves greater results. In contrast, the results of the experiment indicate that increasing the resistance of conventional exercises produced increased activity of all primary and secondary muscles involved and by doing so was noted to be of potential harm to the users body due to other muscles and other joints; i.e., entire spinal column, pelvis, ball-n-socket hip joints, femur bones, knees and ankles, being used.

The participants performed the leg raises illustrated in FIG. 6 to isolate the gluteus maximus muscle. Each participant performed the leg raise exercise utilizing three different ranges of motion my moving the upper body rest 12 and also two different resistance levels by utilizing the resistance bands 116, 118 at two different attachment points on the leg swings 100, 102.

Figure 13:
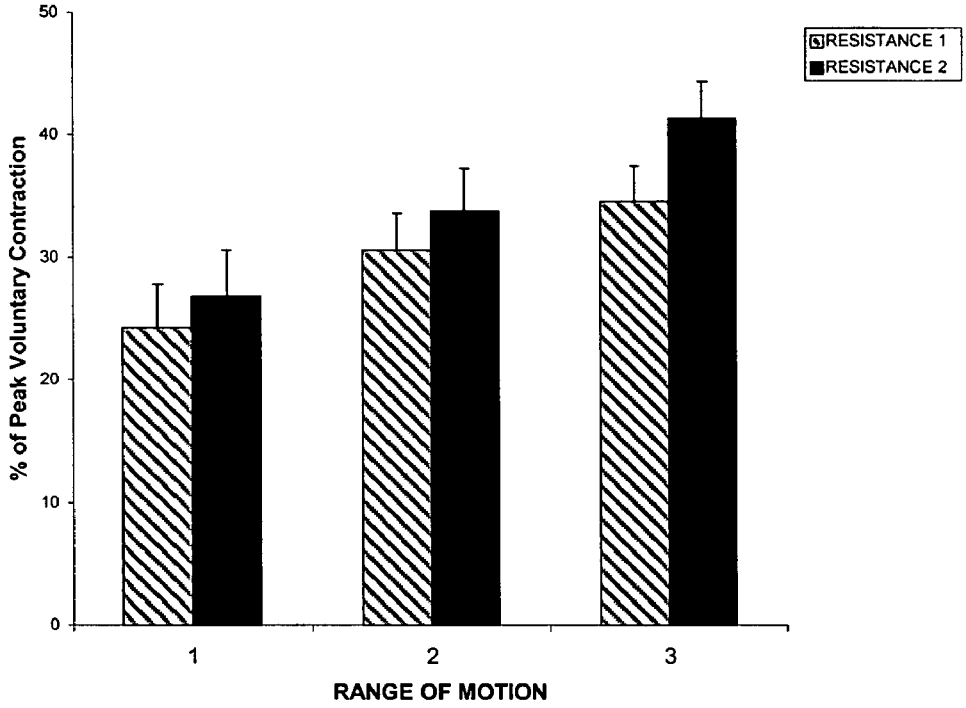
FIG. 13 is a bar graph illustrating the percent of peak voluntary contraction of the gluteus maximus muscle when utilizing the exercise device of the present invention at three ranges of motion while performing the exercise illustrated in FIG. 6.

While utilizing the exercise machine of the present invention while performing the leg raise as illustrated in FIG. 6, the activity of the gluteus maximus muscle during exercise was quantified by correlating the peak voluntary muscle contraction of the gluteus maximus muscle to the different ranges of motion and resistance levels. The results illustrated in FIG. 13 indicate that as the resistance is increased, the muscle activity also increased from about 25% to about 42%. The results also indicate that as the range of motion increases, the activity of the gluteus maximus muscle also increases.

Figure 14:
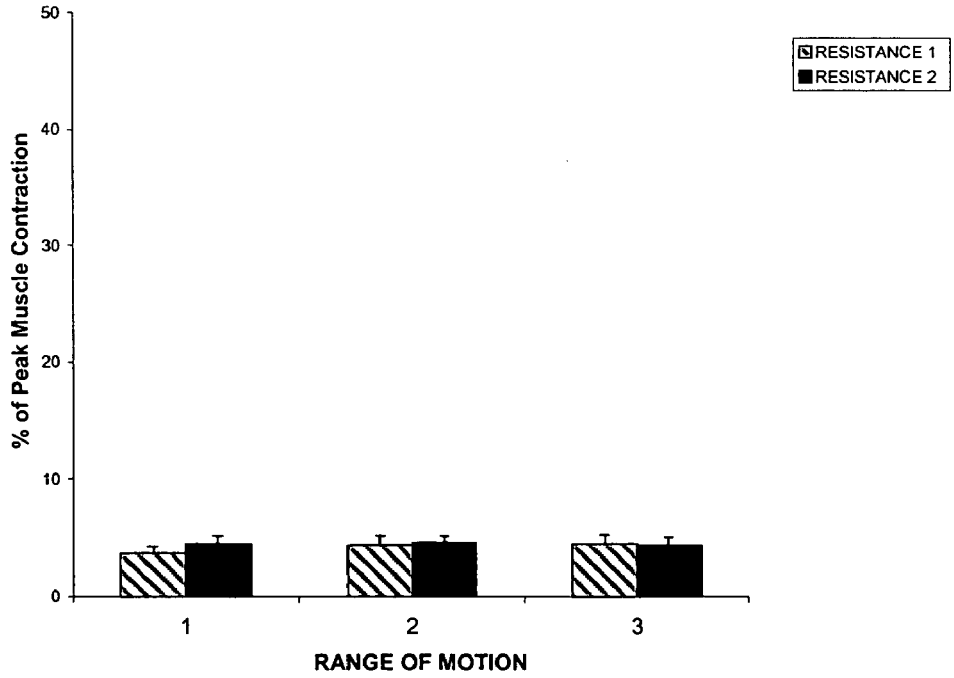
FIG. 14 is a bar graph illustrating the percent of peak voluntary contraction of the quadriceps muscle when utilizing the exercise device of the present invention at three ranges of motion while performing the exercise illustrated in FIG. 6.

Referring to FIG. 14, while and performing the leg raises illustrated in FIG. 6 and utilizing the exercise device 10 of the present invention, the gluteus maximus muscle contractions increased with increases in resistance and the range of motion. However, the effect on the quadriceps activity only slightly increases with increased resistance and range of motion. The results indicate that that as resistance and range of motion are increased during exercise utilizing the exercise device of the present invention, the prime mover muscle being targeted is more effectively being utilized while the secondary muscles are not further engaged.

Figure 15:
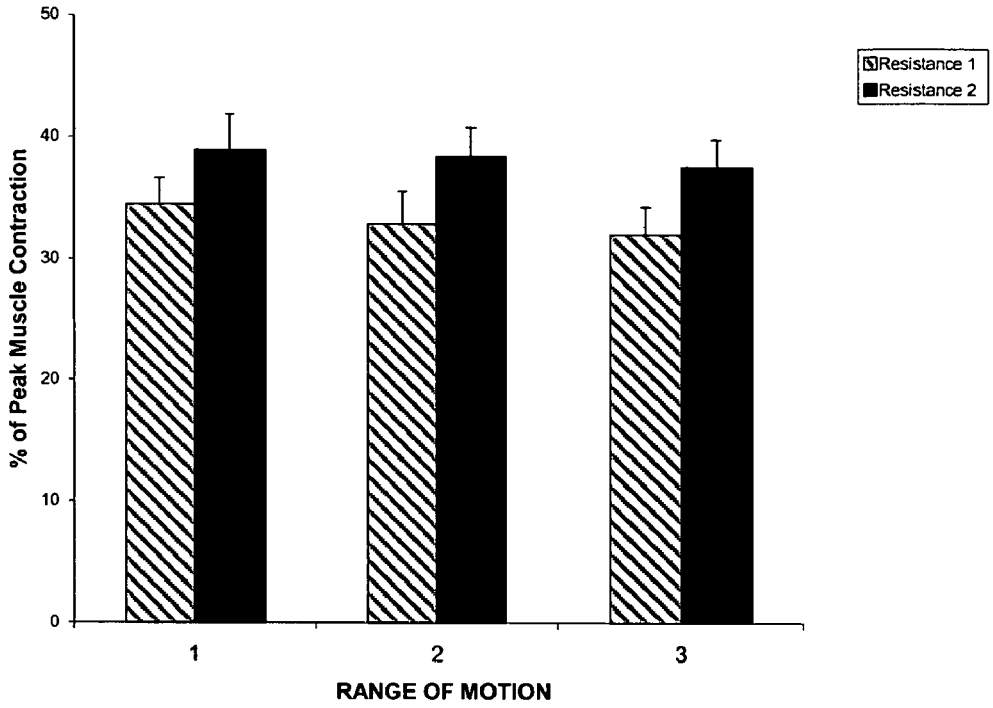
FIG. 15 is a bar graph illustrating the percent of peak voluntary contraction of the hamstring muscle when utilizing the exercise device of the present invention at three ranges of motion while performing the exercise illustrated in FIG. 6.

Referring to FIG. 15, the results of the experiment while performing the leg raises illustrated in FIG. 6 while utilizing the exercise device 10 of the present invention indicate that while the gluteus maximus muscle activity increases with resistance and range of motion, the hamstring activity remains relatively constant. The results indicate that hamstring activity slightly decreases as a range of motion is increased. These result further illustrate the ability of the exercise device of the present invention to isolate the prime mover muscle, such as the gluteus maximus.

Figure 16:
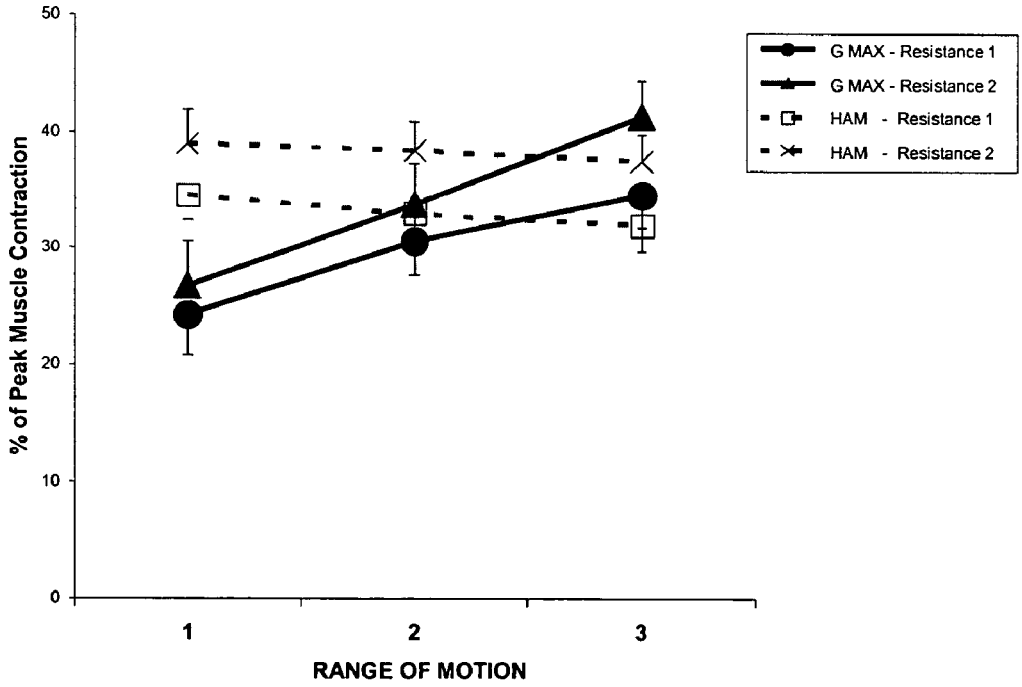
FIG. 16 is a line graph illustrating a comparison between the percent of peak voluntary contraction of the hamstring muscle and the gluteus maximus muscle when utilizing the exercise device of the present invention at three ranges of motion and two resistance levels while performing the exercise illustrated in FIG. 6.

Referring to FIG. 16, a line graph illustrates the activity of the gluteus maximus muscle at two different resistance levels as compared to the hamstring activity while performing the leg raise as illustrated in FIG. 6 and utilizing the exercise device 10 of the present invention at two resistance levels and three different ranges of motion The graph indicates that as the resistance is increased, the gluteus maximus muscle activity also increases. However, the hamstring activity remains relatively constant even through an increased range of motion.

Figure 17:
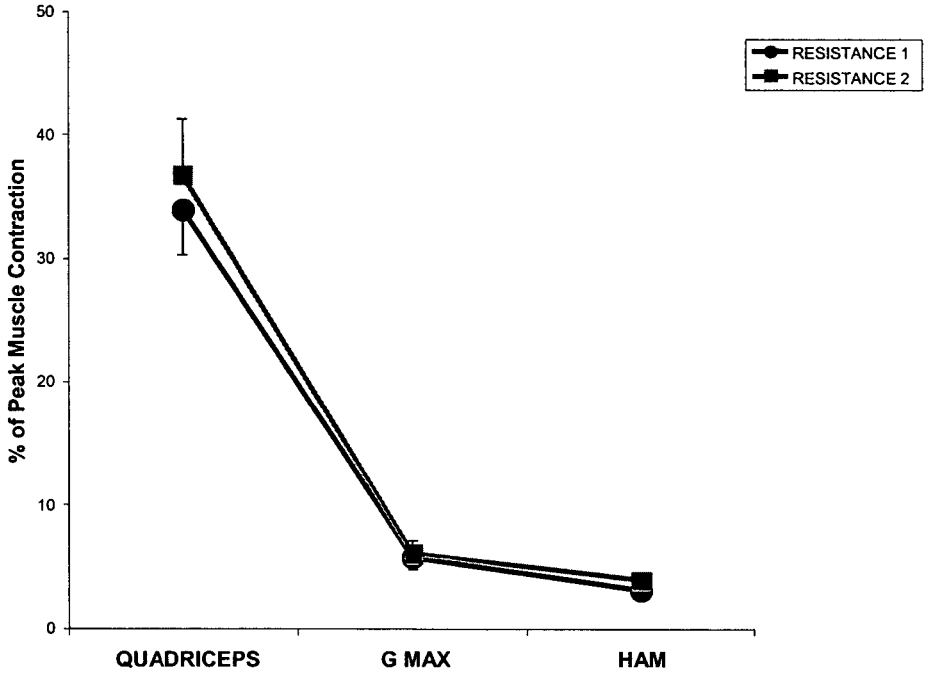
FIG. 17 is a line graph illustrating the percent of peak voluntary contraction of the quadriceps, the gluteus maximus and the hamstring muscle when utilizing the exercise device of the present invention at two resistance levels while performing the leg raise illustrated in FIG. 8.

A leg raise exercise as illustrated in FIG. 8 was performed while utilizing the exercise device 10 of the present invention to isolate the quadriceps muscle. The results of the exercise are illustrated in FIG. 17 which indicate that the quadriceps contractions were between 35 and 40 percent of peak while the gluteus maximus and hamstring muscle contractions were below 5 to 10 percent of the peak contraction. The results of this test indicate that the quadriceps was being isolated and contracted while the gluteus maximus muscle and the hamstring were not being activated by the exercise.

The gluteus maximus, quadriceps and hamstrings were also evaluated during the use of a squat, lunge and a step-up. The results of the tests are provided in FIG. 18. The results of the test indicate that conventional exercises such as squats, lunges and step-ups mostly activate the quadriceps and do not activate to the same extent the gluteus maximus muscle and the hamstrings.

Figure 18:
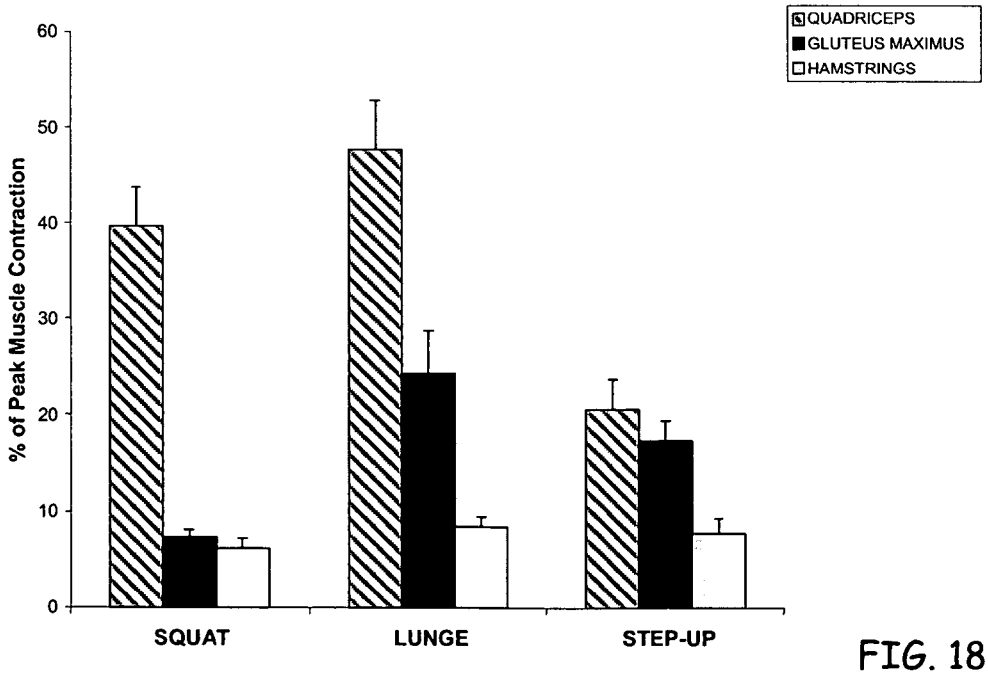
FIG. 18 is a bar graph illustrating the percent of peak voluntary contraction of the quadriceps muscle, the gluteus maximus muscle and the hamstrings while performing a squat, a lunge and a step-up.
Figure 19:
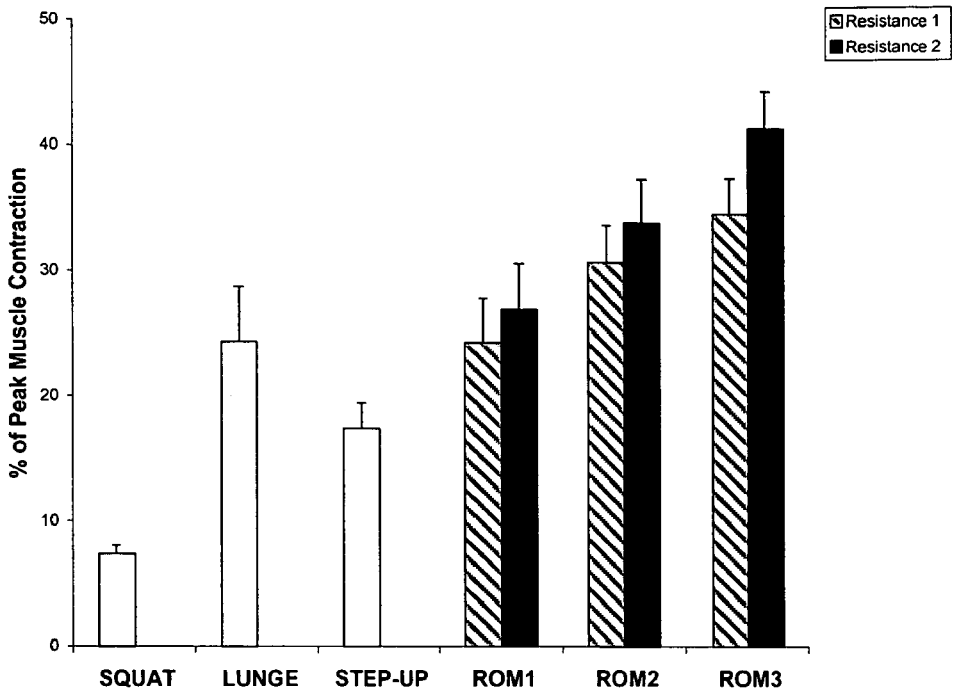
FIG. 19 is a bar graph illustrating the percent of peak voluntary contraction of the gluteus maximus muscle while performing a squat, a lunge and a step-up and when utilizing the exercise device of the present invention at three ranges of motion and two resistance levels while performing the exercise illustrated in FIG. 6.

When compared to the exercise device 10 of the present invention at the lowest range of motion, the squat, lunge and step-up do not provide the peak muscle contraction of the gluteus maximus. Referring to FIG. 18, the results indicate that as the range of motion increases and the resistance increases when performing the leg raises as illustrated in FIG. 6 while utilizing the exercise device 10 of the present invention, the gluteus maximus muscle activity also increases which indicates the effectiveness of the device 10 of the present invention as compared to conventional exercising methods. The results of the testing indicates that a lunge is as about as effective as using the exercise device 10 of present invention at the lowest range of motion with a lower resistance. However, as the range a motion increases, the effectiveness of the present invention exceeded the effectiveness of any of the conventional exercising techniques in isolating an exercise in the gluteus maximus muscle.

Figure 20:
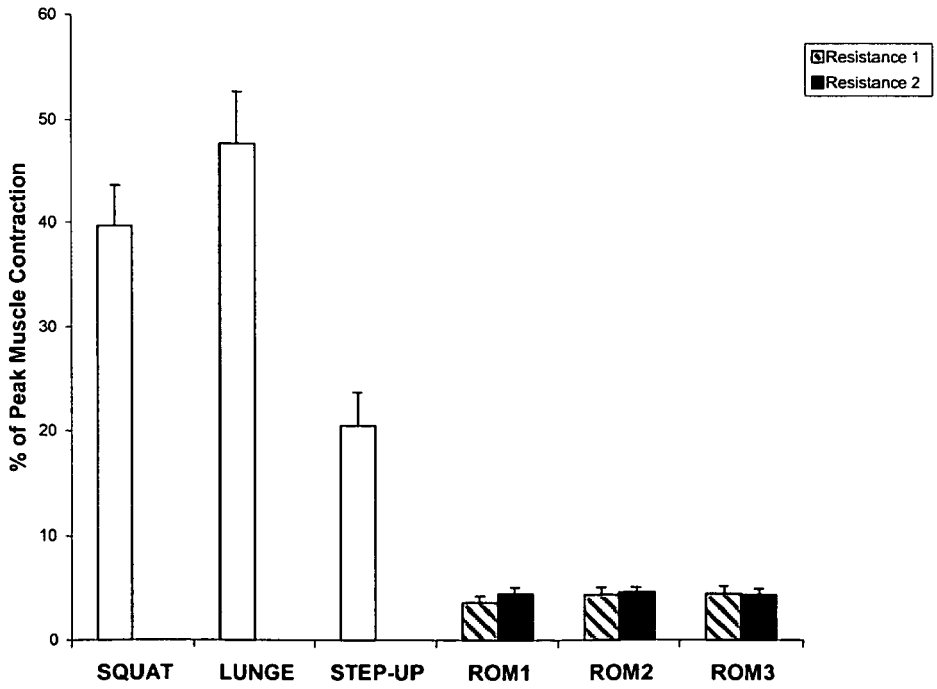
FIG. 20 is a bar graph illustrating the percent of peak voluntary contraction of the quadriceps muscle while performing a squat, a lunge and a step-up and when utilizing the exercise device of the present invention at three ranges of motion and two resistance levels while performing the exercise illustrated in FIG. 6.

When utilizing the exercise device 10 of the present invention when isolating the gluteus maximus muscle when performing the leg raise illustrated in FIG. 6, the quadriceps muscle activity was significantly lower than the quadriceps activity that was seen when doing conventional exercises such as squats, lunges and step-ups as illustrated in FIG. 20. The increased quadriceps activity detracts from the effectiveness of the conventional exercise in isolating the gluteus maximus muscle.

Figure 21:
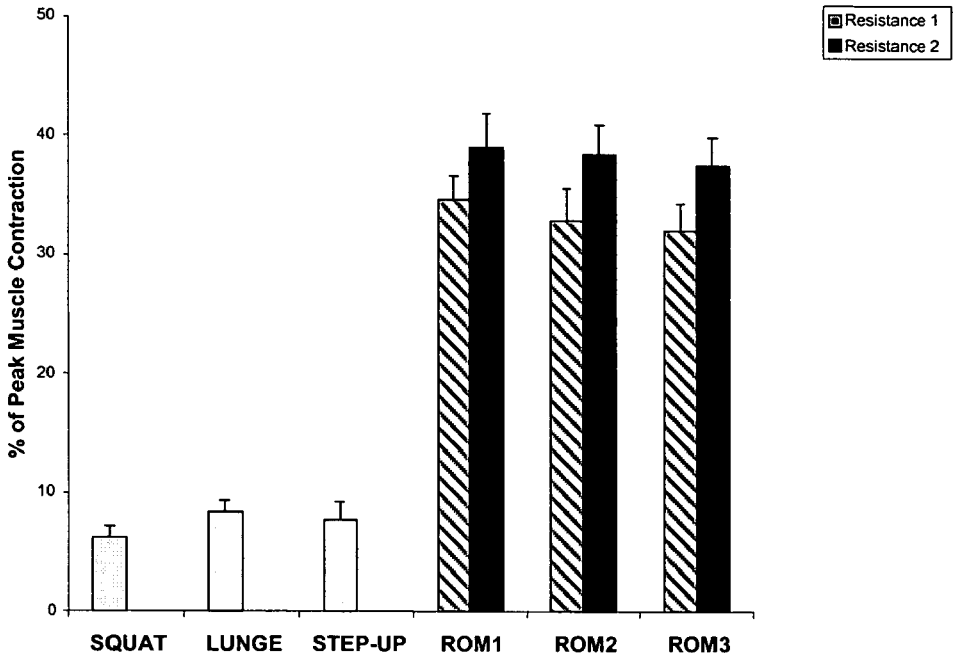
FIG. 21 is a bar graph illustrating the percent of peak voluntary contraction of the hamstring muscle while performing a squat, a lunge and a step-up and when utilizing the exercise device of the present invention at three ranges of motion and two resistance levels while performing the exercise illustrated in FIG. 6.

Referring to FIG. 21, the hamstring activity using barbell weights during conventional exercises was below 10% of peak muscle contraction using conventional exercising techniques. In comparison, the hamstring activity utilizing the exercise device 10 of the present invention was between 30 and 40% during all ranges of motion and resistances tested when performing the leg raise as illustrated in FIG. 6. The test results indicate that the exercise device 10 of the present invention is more effective at isolating and exercising the back of the leg and gluteus maximus muscle when compared to a squat, lunge or a step-up.

Figure 22:
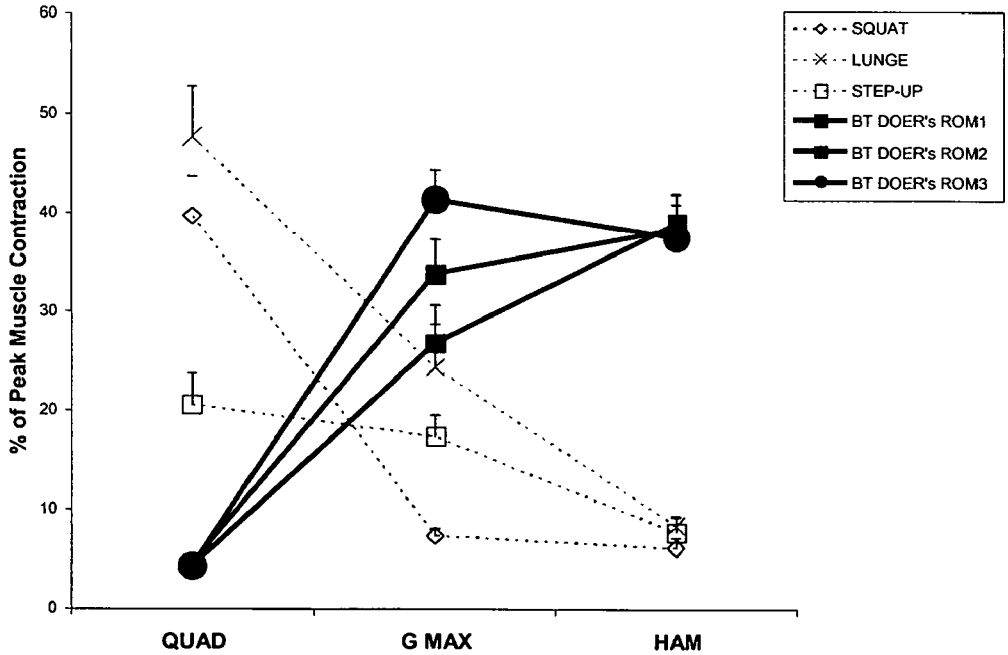
FIG. 22 is a line graph illustrating the percent of peak voluntary contraction of the quadriceps muscle, the gluteus maximus, and the hamstring muscle while performing a squat, a lunge and a step-up and utilizing the exercise device of the present invention at three ranges of motion while performing the exercise illustrated in FIG. 6.

FIG. 22 illustrates the comparison of the muscle activity when comparing the exercise device 10 of the present invention when performing the leg raises as illustrated in FIG. 6 at three separate ranges of motion as compared to a squat, lunge and step up. The results indicate that the use of the exercise device 10 of the present invention isolates the gluteus maximus muscle is a more effective manner than either a squat, lunge or a step-up. Further, the hamstring is has more activation when using the exercise device 10 of the present invention when compared to the other conventional exercise techniques. Significantly, the quadriceps is not being significantly contracted when using the present invention to isolate the gluteus maximus muscle, while the quadriceps has greater activity when performing a squat, lunge and step-up. Therefore, the results of this experiment indicate that the use of exercise device 10 of the present invention is much more effective as isolating and exercising the gluteus maximus muscle and hamstring than the conventional exercise techniques of a squat, lunge or a step up.

Although the present invention has been described with reference to preferred embodiments, workers skilled in the art will recognize that changes may be made in form and detail without departing from the spirit and scope of the invention.

The invention claimed is:

1. An exercise device comprising:

a base comprising an upper portion and a lower portion wherein one of the upper portion and the lower portion is positionable within a cavity of the other to adjust a height of the base;

an upper body rest pivotally attached to the base and wherein the upper body rest supports a torso of an exerciser when the exerciser is in a standing position;

a first leg swing pivotally attached to the base and extending downward from the base, the first leg swing for engaging a first leg of the exerciser to perform a first leg raise; and a second leg swing pivotally attached to the base and extending downward from the base, the second leg swing for engaging a second leg of the exerciser to perform a second leg raise wherein the upper body rest, the first leg swing and the second leg swing are connected to the base with a common pivot.

2. The exercise device of claim 1 and wherein the upper body rest is securable in selected positions from a substantially vertical position to a substantially horizontal position and a plurality of positions between the substantially vertical position and the substantially horizontal position.

3. The exercise device of claim 1 and further comprising a first resistance device attached to the first leg swing for increasing muscle activity while performing the first leg raise.

4. The exercise device of claim 3 and wherein the first resistance device comprises a first resistance band that attaches to the base and the first leg swing.

5. The exercise device of claim 4 and wherein the first leg swing comprises a plurality of attaching device attached to the first leg swing along a length of the leg swing and wherein moving the attachment of the first resistance band between the plurality of attaching devices varies the resistance when performing the first leg raise.

6. The exercise device of claim 1 and further comprising a second resistance device attached to the second leg swing for increasing muscle activity while performing the second leg raise.

7. The exercise device of claim 6 and wherein the second resistance device comprises a second resistance band that attaches to the base and the second leg swing.

8. The exercise device of claim 7 and wherein the second leg swing comprises a plurality of attaching device attached to the second leg swing along a length thereof and wherein moving the attachment of the second resistance band between the plurality of attaching devices varies the resistance when performing the second leg raise.

9. The exercise device of claim 1 and wherein the height of the base is adjusted to adjust a height of a bottom end of the upper body rest.

10. An exercise device comprising:

a base;

an upper body rest attached to the base and wherein the upper body rest supports a torso of an exerciser;

a first leg swing comprising a proximal end pivotally attached to the base and wherein the first leg swing extends downward from the upper body rest, wherein a distal end of the first leg swing comprises a first extension that is rotatably attached to the first leg swing wherein the first extension engages a first leg of the exerciser to perform a first leg raise wherein the first extension rotates and rolls upward on the first leg the exerciser as the first leg raise is performed; and a second leg swing comprising a proximal end pivotally attached to the base and wherein the second leg swing extends downward from the upper body rest, wherein a distal end of the second leg swing comprises a second extension that is rotatably attached to the second leg swing wherein the second extension engages a second leg of the exerciser to perform a second leg raise wherein the second extension rotates and rolls upward on the second leg of the exerciser as the second leg raise is performed and wherein the first and second leg swings move independent of each other.

11. The exercise device of claim 10 and further comprising:

a first resistance device for engaging the first leg swing to increase a resistance when performing the first leg raise; and a second resistance device for engaging the second leg swing to increase a resistance when performing the second leg raise.

12. The exercise device of claim 11 and wherein the first and second resistance devices each comprise a resistance band that attaches to the base and to the first or second leg swing.

13. The exercise device of claim 12 and wherein the resistance bands are securable in a plurality of positions along lengths of both the first and second leg swings.

14. The exercise device of claim 13 and wherein the upper body rest pivotally attaches to the base and is securable in selected positions from a substantially vertical position to a substantially horizontal position and a plurality of positions between the substantially vertical position and the substantially horizontal position.

15. A method of isolating and exercising the gluteus maximus muscle comprising:

providing a machine with a base, an upper body rest pivotally attached to the base and at least one leg swing pivotally attached to the base and having an extension rotatably attached to the at least one leg swing;

positioning the upper body rest in a first selected position;

positioning a chest of the exerciser proximate the upper body rest while in a standing position and engaging the extension of the at least one leg swing with a back of a bottom portion of the leg; and raising the leg in a substantially vertical direction that engages and lifts the at least one leg swing to isolate and exercise the gluteus maximus muscle and wherein as the leg is raised the extension rotates and rolls up the back of the bottom portion of the leg.

16. The method of claim 15 and further comprising further positioning the upper body rest in a second selected position closer to horizontal than the first selected position to increase the range of motion of the leg during the leg raise to increase the activity of the gluteus maximus muscle.

17. The method of claim 15 and further comprising attaching a resistance device to the at least one leg swing to increase a resistance to the leg when raising the at least one leg swing.

18. The method of claim 15 and further comprising attaching a resistance band to the base and the at least one leg swing to increase a resistance to the leg when raising the at least one leg swing.

19. The method of claim 18 and further comprising adjusting a position of the attachment of the resistance band to the at least one leg swing to adjust the resistance to the when raising the at least one leg swing.

* * * * *

UNITED STATES PATENT AND TRADEMARK OFFICE

CERTIFICATE OF CORRECTION

PATENT NO. : 7,691,041 B2
APPLICATION NO. : 11/269448
DATED : April 6, 2010
INVENTOR(S) : John S. Abdo It is certified that error appears in the above-identified patent and that said Letters Patent is hereby corrected as shown below:

Col. 13, lines 2, claim 8 please change "device" to -- devices --

Col. 14, line 41, claim 19 after "resistance", please delete "to the"

Signed and Sealed this

Fifteenth Day of June, 2010

David J. Kappos

David J. Kappos
*Director of the United States Patent and Trademark Office*